US006605400B2

(12) United States Patent
Itami et al.

(10) Patent No.: US 6,605,400 B2
(45) **Date of Patent: *Aug. 12, 2003**

(54) ELECTROPHOTOGRAPHIC PHOTORECEPTOR

(75) Inventors: Akihiko Itami, Hachioji (JP); Masao Asano, Hachioji (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/110,665

(22) Filed: Jul. 6, 1998

(65) Prior Publication Data

US 2002/0037463 A1 Mar. 28, 2002

(30) Foreign Application Priority Data

Jul. 8, 1997 (JP) ..... 9-182349
Jul. 22, 1997 (JP) ..... 9-195580

(51) Int. Cl.[7] ..... G03G 5/147

(52) U.S. Cl. ..... 430/66; 430/133; 430/134; 430/59.6; 430/132

(58) Field of Search ..... 430/133, 134, 430/56, 132, 66, 59.6

(56) References Cited

U.S. PATENT DOCUMENTS 4,962,008 A * 10/1990 Kimura et al. ..... 430/66
5,759,725 A * 6/1998 Hirao et al. ..... 430/58
5,800,955 A * 9/1998 Kashimura et al. ..... 430/96
5,981,125 A * 11/1999 Itami ..... 430/134

OTHER PUBLICATIONS

Aldrich Handbook of Fine Chemicals and Laboratory Equipment. p. 698. (2000).*

* cited by examiner

*Primary Examiner*—Christopher Rodee
(74) *Attorney, Agent, or Firm*—Muserlian, Lucas and Mercanti

(57) ABSTRACT

An electrophotographic photoreceptor is disclosed. A surface layer of the photoreceptor comprises binder resin having silicon or fluorine atoms and dioxolan or a derivative thereof at 0.001 to 10 weight percent.

15 Claims, No Drawings

ELECTROPHOTOGRAPHIC PHOTORECEPTOR

FIELD OF THE INVENTION

The present invention relates to a highly durable electrophotographic photoreceptor which minimizes wear and damage of the surface layer during repeated image-forming processes, and fatigue degradation due to incomplete cleaning, etc.

BACKGROUND OF THE INVENTION

In order to carry out image formation employing an electrophotographic method, the surface of an electrophotographic photoreceptor is charged, exposed imagewise and developed to form a toner image. The toner image is transferred onto a transfer material and fixed to form an image. The photoreceptor which has completed the image transfer is subjected to cleaning and discharging, and is repeatedly employed.

The above-mentioned photoreceptor is required to exhibit excellent electrophotographic properties such as charging potential, sensitivity, residual potential, etc.; in addition to these, physical properties such as long printing life, wear, moisture, etc. during repeated usage, and resistance against ozone, generated by corona discharging and image exposure.

It is commonly assumed that the fatigue-caused degradation of electrophotographic properties of a photoreceptor during the repeated usage is caused by the wear and damage to the surface layer of the photoreceptor during each process such as transfer of toner images formed on the photoreceptor to transfer materials, separation, cleaning of residual toner from the photoreceptor after the transfer, and film formed by hygroscopic substances such as toner, paper dust, etc.

Conventionally, for the above-mentioned photoreceptors, there have been widely employed inorganic photoreceptors, comprising inorganic photoconductive materials, and organic photoreceptors, comprising organic photoconductive materials.

The organic photoreceptors are those prepared by coating, on a conductive support, a photosensitive composition prepared by dissolving or dispersing an organic photoconductive material in a solvent, together with a binder, if desired. Particularly, a function-separated type photoreceptor is practically important in which the charge generating function and the charge transport function are performed by different materials. As the function-separated type photoreceptors, many photoreceptors are employed which specifically comprise a charge generating layer comprising a charge generating material, and a charge transport layer comprising a charge transport material.

The surface of a photoreceptor, prepared by coating an organic or inorganic photoconductive material employing a solvent, is soft compared to a photoreceptor prepared by depositing inorganic photoconductive materials such as selenium, amorphous silicone, etc. employing vaporization, glow discharge, etc., and results in disadvantages such as being susceptible for the increased wear and damage during repeated usage and film formed by hygroscopic materials due to incomplete cleaning. On account of this, improvement in physical properties of the surface layer of the photoreceptor is much in demand.

For example, in Japanese Patent Publication Open to Public Inspection No. 5-113670, a method to prevent the formation of film made by toner, paper dust, etc. is proposed in which siloxane-copolymerized polycarbonate is incorporated into the surface layer of a photoreceptor as a binder resin to make the surface layer of the photoreceptor lubricant and to improve the cleaning properties, and in Japanese Patent Publication Open to Public Inspection No. 4-368953, fine particles of fluoro-resin are incorporated into the surface layer of a photoreceptor in order to obtain the same effects as above.

In Japanese Patent Publication Open to Public Inspection No. 3-155558, a method to improve wear resistance of the surface of a photoreceptor is proposed in which fine inorganic particles such as silica, tin oxide, etc. are incorporated into the surface layer of the photoreceptor.

As a solvent for the inorganic photoreceptor which is prepared by coating a photosensitive composition comprising the above-mentioned inorganic photoconductive material, toluene, tetrahydrofuran, dioxane, methyl ethyl ketone, cyclohexane, etc. have been employed. However, these solvents exhibit poor solubility for binder resins employed for an organic photoreceptor comprising an organic photoconductive material. Instead of these, halogenated solvents such as methylene chloride, ethylene chloride, chloroform, monochlorobenzene, etc. are mainly employed. The halogenated solvents exhibit good solubility and coating properties for binder resins of an organic photoreceptor such as polycarbonate, polyacrylate, etc.

SUMMARY OF THE INVENTION

In the photoreceptor which is prepared by coating a photosensitive composition comprising the above-mentioned inorganic or organic photoconductive material, a part of the solvent inevitably remains in the photosensitive layer during the drying process following coating. This remaining solvent lowers or deletes improvements in wear resistance and degrades cleaning properties of the surface layer of the photoreceptor described, for example, in the above-mentioned references, and when image formation is repeated employing the photoreceptor, it is subjected to fatigue degradation due to wear and damage of the surface layer of the photoreceptor, incomplete cleaning, etc., which result in defective images due to the decrease in image density and formation of background staining.

The above-mentioned halogenated solvents require decreased usage amounts due to environmental pollution and possible carcinogenicity.

By employing dioxolan or a derivative as a solvent for a photosensitive composition, it was found that excellent solubility or dispersing properties is exhibited for photoconductive materials and binder resins and in addition, causes no environmental pollution, carcinogenicity, or ozone depletion. Furthermore, when the optimum amount of dioxolan or the derivative remains in the photosensitive layer, improvements in wear resistance and cleaning properties are further enhanced.

An object of the present invention is to provide a photoreceptor which exhibits improvements in wear resistance and cleaning properties, minimum fatigue degradation during the repeated image-forming process employing the above-mentioned photoreceptor repeatedly, no formation of background staining over an extended period, and stably produces clear images of high density.

MEANS TO SOLVE THE PROBLEMS

The photoreceptor of the present invention and its embodiment are described.

The electrophotographic photoreceptor of the present invention comprises an conductive support having thereon a photosensitive layer, and the surface layer of the photoreceptor comprises binder resin having silicon or fluorine atoms and dioxolan or a derivative thereof at 0.001 to 10 weight percent.

The surface layer may preferably comprise fine organic particles. The fine organic particles are preferably a compound comprising fluorine.

The surface layer may preferably comprise fine inorganic particles. The fine inorganic particles are preferably oxides of silicon or tin.

The surface layer of the photoreceptor may comprise both of fine inorganic and organic particles. The fine organic particles preferably comprise fluorine atoms and fine inorganic particles are preferably oxides of silicon or tin.

The surface layer preferably contains silicone oil.

The electrophotographic photoreceptor comprises an conductive support having thereon a photosensitive layer and the surface layer of the photoreceptor comprises fine organic particles and dioxolan or a derivative thereof at 0.001 to 10 weight percent.

These fine organic particles are preferably a compound comprising fluorine atoms.

The surface layer of this photoreceptor preferably comprises a binder resin having silicon or fluorine atoms.

An electrophotographic photoreceptor comprises an conductive support having thereon a photosensitive layer and the surface layer of the photoreceptor comprises fine inorganic particles and dioxolan or a derivative thereof at 0.001 to 10 weight percent.

The fine inorganic particles are preferably oxides of silicon or tin.

The surface layer of the photoreceptor preferably comprises a binder resin having silicon or fluorine atoms.

The electrophotographic photoreceptor compries an conductive support having thereon a photosensitive layer and the surface layer of the photoreceptor comprises fine inorganic and organic particles, and dioxolan or a derivative thereof in 0.001 to 10 weight percent.

The fine organic particles preferably comprise fluorine atoms and fine inorganic particles are preferably oxides of silicon or tin.

The surface layer of the photoreceptor preferably contains silicone oil.

DETAILED DESCRIPTION OF THE INVENTION

The present invention is further detailed below.

Incorporated into the surface layer of a photoreceptor, are a binder resin comprised of silicon or fluorine atoms which makes the surface layer lubricant and also comprised of fine organic particles and/or fine inorganic particles intended to make the surface layer wear resistant. Along with the above-mentioned resin and particles, dioxolan or a derivative thereof is employed as a solvent for the coating composition to form the surface layer of the photoreceptor, and further 0.001 to 10 weight percent of the dioxolan or a derivative thereof is incorporated into the dried surface layer of the photoreceptor.

The photoreceptor comprises an inorganic photoconductive material or organic photoconductive material in its binder resin. The organic photoreceptor is mainly explained below.

Binder resins containing silicon or fluorine atoms, which are incorporated into the surface layer of the photoreceptor include those mentioned below.

(Binder Resins Comprising Silicon Atoms)

These resins include siloxane-carbonate block-copolymers and siloxane-ester block-copolymers described on pages 5 and 6 of Japanese Patent Publication Open to Public Inspection No. 3-171056; the siloxane-carbonate block-copolymers described on pages 5 to 7 of Japanese Patent Publication Open to Public Inspection No. 5-113670, and the siloxane-carbonate block-copolymers described on pages 11 to 14, 16 to 20, 23 to 32, and 35 to 37 of Japanese Patent Publication Open to Public Inspection No. 8-87119.

Siloxane-ester Block-Copolymers:

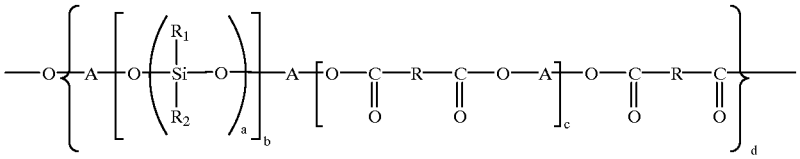

wherein R represents an alkylene group having from 3 to 20 carbon atoms; A represents an alkylene or arylene group having from 2 to 20 carbon atoms; $R_1$ and $R_2$ each represents an alkyl group having from 2 to 10 carbon atoms, or $R_2$ represents an alkyl group, an aralkyl group, an alkaryl group or an aryl group; "a" represents 10 to 200; "b" represents 1 to 25; "c" represents 5 to 20; "d" represents 2 to 1,000. In the above-mentioned structural formula, A represents phenylene or bisphenylnene preferably comprising the following formula:

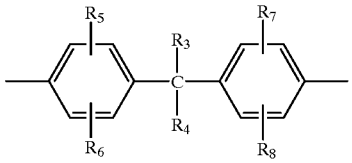

wherein $R_3$ and $R_4$ each represents a hydrogen atom or an alkyl group, a substituted alkyl group, an aryl group, an anthracenyl group, a substituted aryl group, or $R_3$ and $R_4$ form a single ring, double ring, or heterocyclic group together with bonding carbon atoms. $R_5$, $R_6$, $R_7$, and $R_8$ each independently represents a hydrogen atom, or a halogen atom, or an alkyl group, a substituted alkyl group, an aryl group, or a substituted aryl group.

Siloxane-bisphenolcarbonate Block-Copolymers:

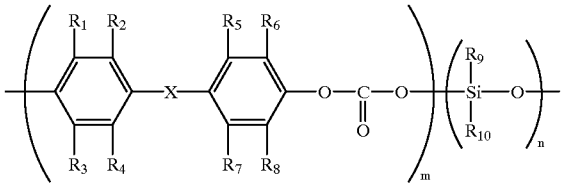

wherein $R_1$, $R_2$, $R_3$, $R_4$, $R_5$, $R_6$, $R_7$, and $R_8$ each represents a hydrogen atom, a halogen atom, a lower alkyl group; X represents —O—, —CO—, —S—, —$SO_2$— bonding group, and an alkylene group, and $R_9$ and $R_{10}$ each represents a lower alkyl group; m/(m+n) is 0.2 to 0.8.

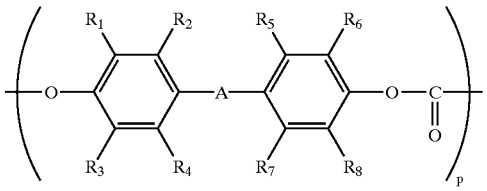

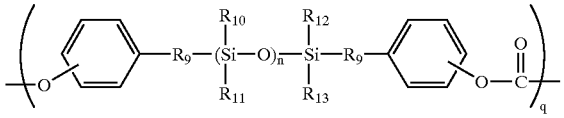

A represents

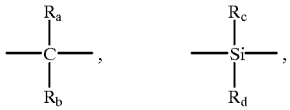

—S—, —$SO_2$—, —CO—, —O— or —$(CH_2)_w$, or direct bonding is allowed without A.

wherein $R_1$, $R_2$, $R_3$, $R_4$, $R_5$, $R_6$, $R_7$, and $R_8$ each represents a hydrogen atom, a halogen atom, a lower alkyl group; w represent an integer of 2 or more; $R_a$ and $R_b$ each represents a hydrogen atom, a substituted or unsubstituted alkyl or aryl group, or represent a group of atoms necessary for forming a carbon ring or heterocyclic ring upon combining with each other; $R_c$ and $R_d$ each represents a substituted or unsubstituted alkyl or aryl group. p and q represent a number which satisfies the relation of p/(p+q)=0.1 to 0.9. $R_9$ represents an alkylene or alkylidene having from 2 to 6 carbon atoms; $R_{10}$, $R_{11}$, $R_{12}$, and $R_{13}$ each represents an alkyl group having from 1 to 3 carbon atoms, a phenyl group, or a substituted phenyl group; n represents an integer of 1 to 200.

(Binder Resins Comprising Fluorine Atoms)

These resins include, for example, carbonate-fluorine-substituted paraffin block-copolymers described on page 3 of Japanese Patent Publication Open to Public Inspection No. 3-45958 and also polycarbonates having a fluorine substituent described on pages 2 to 4 of Japanese Patent Publication Open to Public Inspection No. 5-188628.

Combination of a main segment polymer (hereinafter referred to as "A") and a fluorine atom containing segment polymer (hereinafter referred to as "B"):

Combinations of A and B are optional such as A-B, A-B-A, A-B-A-B, etc., and the ratio is not particularly limited.

Specific examples of representative combinations of A and B are illustrated below.

"As" include methacryl series polymers such as polymethyl methacrylate, polyethyl methacrylate, polybutyl methacrylate, polyhexyl methacrylate, polydecyloctyl methacrylate, polystearyl methacrylate, etc.; acryl series polymers such as polymethyl acrylate, polyethyl acrylate, polybutyl acrylate, poly-2-ethylhexyl acrylate, polymethoxyethyl acrylate, etc.; vinyl acetate series polymers such as polyvinyl acetate, vinyl acetate ethylene copolymers, etc.; styrene series polymers such as polystyrene, chloromethylated polystyrene, styrene-butadiene copolymers, styrene-methacrylate copolymers, etc.; polycarbonate series polymers such as representative examples mentioned below.

Structural Formula (1) of Polycarbonate Series Polymers

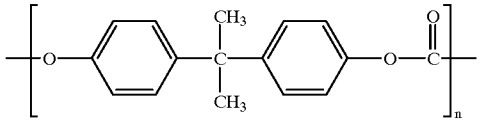

Structural Formula (2) of Polycarbonate Series Polymers

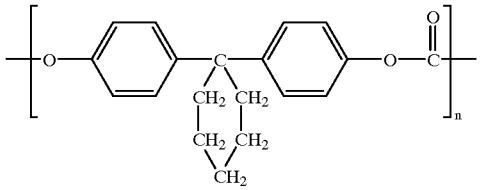

Structural Formula (3) of Polycarbonate Series Polymers

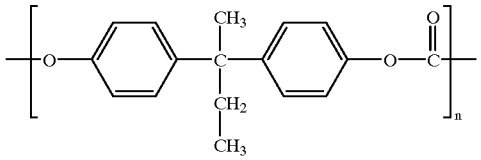

Structural Formula (4) of Polycarbonate Series Polymers

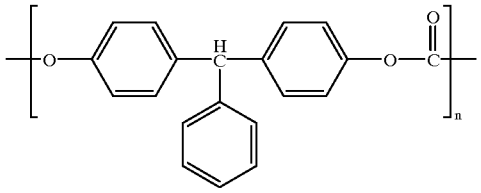

Structural Formula (5) of Polycarbonate Series Polymers

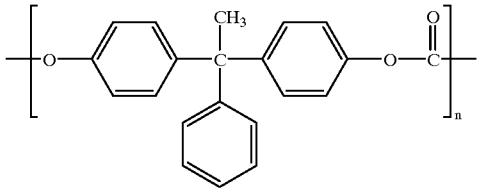

Structural Formula (6) of Polycarbonate Series Polymers

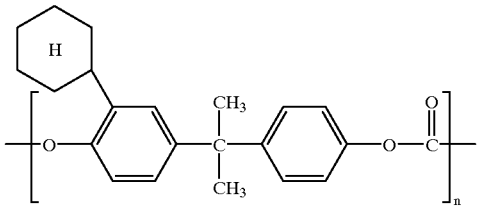

Structural Formula (7) of Polycarbonate Series Polymers

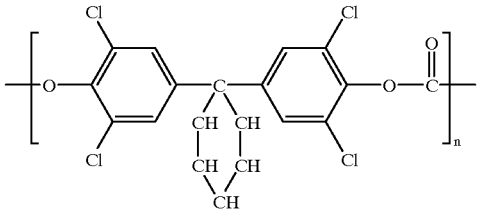

"As" further include polyester series polymers such as unsaturated polyesters composed of styrene, maleic acid, ethylene glycol, phthalic acid, etc., alkyd resins composed of phthalic acid, glycols, etc.

As "B", fluorine-substituted paraffin series polymers are employed.

Representative examples include polyvinylidene fluoride, polyvinyl fluoride, ethylene-tetrafluoroethylene copolymers, tetrafluro-hexafuoropropylene copolymers, etc.

Polycarbonates comprising a terminal structure represented by the following formula;

$$—Ar—(R)_m—Rf$$

wherein Ar represents an aryl group which is allowed to have a substituent; m represents an integer of 0 or 1; R represents an alkyl group, an oxygen atom, an sulfur atom, —CO—, —CO—O—, —NH—CO— and a combination of two of these or more; Rf represents a long chain fluorinated alkyl group.

Specifically, Ar represents

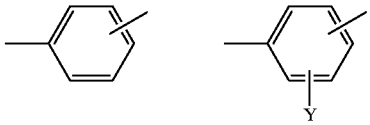

wherein Y represents a methyl group, a chlorine atom, a bromine atom, a fluorine atom, an iodine atom, a cyan group, a trifluoromethyl group, a nitro group or a hydrogen atom.

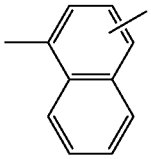

Rf represents $—(CF_2)_7—CF_3$, $—(CF_2)_9—CF_3$, $—(CF_2)_{11}—CF_3$, $—(CF_2)_{13}—CF_3$, $—(CF_2)_{15}—CF_3$, $—(CF_2)_{17}—CF_3$,

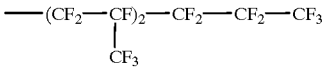

R represents $—CH_2—$, $—CH_2CH_2—$, $—O—CH_2—$, $—O—CH_2—CH_2—$, $—CO—CH_2—$, $—CO—CH_2—CH_2—$, $—CO—O—CH_2—$, $—CO—O—CH_2—CH_2—$, $—O—CO—CH_2—$, $—O—CO—CH_2—CH_2—$, $—CO—NH—CH_2—CH_2—$, $—CO—NH—CH_2—CH_2—$, $—NH—CO—CH_2—$, $—NH—CO—CH_2—CH_2—$, —O—, —CO—, —CO—O—, —O—CO—, —NH—CO—, —S—, $—SO_2—$ $—Ar—(R)_m—Rf$ represents;

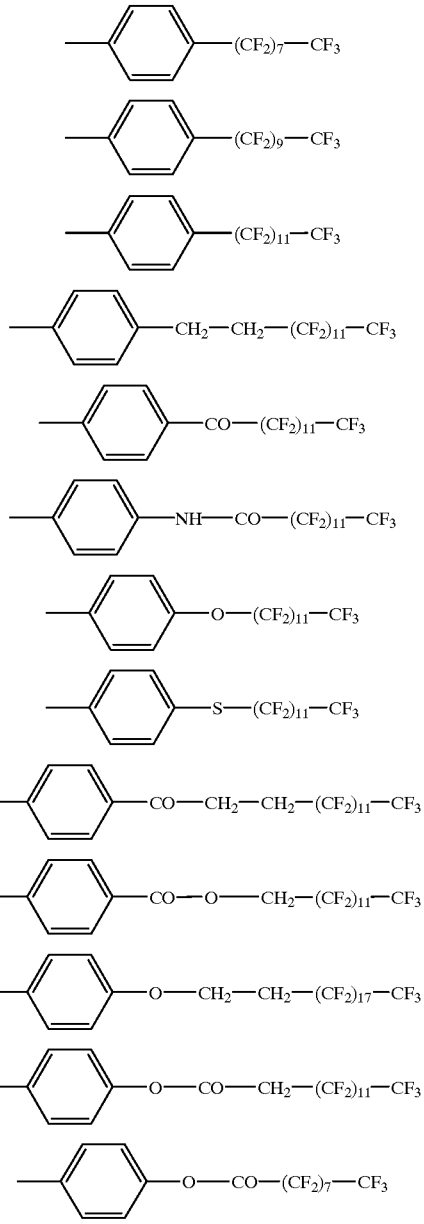

-continued

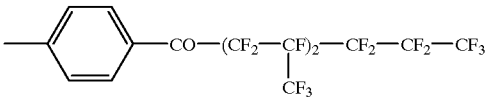

The content amount of the above-mentioned binder resin comprising silicon or fluorine atoms in the surface layer of the photoreceptor is preferably 0.1 weight percent or more, and more preferably 1 weight percent or more of the resin in the above-mentioned surface layer. When the content amount is not more than 0.1 weight percent, insufficient lubricating properties are provided, and further, during image formation, incomplete cleaning is exhibited.

Fine organic particles and fine inorganic particles which can be incorporated into the surface layer of the photoreceptor include these mentioned below.

Examples of the fine organic particles include polytetrafluoroethylene, polyvinylidene fluoride, polyethylene chloride trifluoride, polyvinyl fluoride, polyethylene tetrafluoride-perfluoroalkylvinylether copolymer, polyethylene tetrafluoride-propylene hexafluoride copolymer, polyethylene-trifluoride ethylene copolymer, polyethylene tetrafluoride-propylene hexafluoride-perfluoroalkylvinylether copolymer, polyethylene, polyvinyl chloride, metal stearate salt, polymethylmethacrylate or melamine. The volume average diameter of the fine organic particles is preferably between 0.05 and 10 $\mu$m. The amount of fine organic particles incorporated into the surface layer of the photoreceptor is preferably between 0.1 and 100 weight percent of the binder resin in the surface layer, and more preferably between 1 and 50 weight percent, so that the photosensitive layer is provided with sufficient lubricating properties to prevent incomplete cleaning and to obtain the preferred sensitivity and minimal background staining.

Examples of fine inorganic particles include metal oxides such as magnesium oxide, calcium oxide, titanium oxide, zirconium oxide, tin oxide, aluminum oxide, silicon oxide (silica), indium oxide, beryllium oxide, lead oxide, and bismuth oxide; nitrides such as boron nitride, aluminum nitride, and silicon nitride, and carbides such as silicon carbide and boron carbide. Fine inorganic particles are preferably subjected to hydrophobic treatment employing hydrophobic processing agents such as titanium coupling agents, silane coupling agents, aluminum coupling agents, high molecular fatty acids, etc.

The volume average particle diameter is preferably between 0.05 and 2 $\mu$m. Furthermore, in order to provide sufficient mechanical strength with the surface layer of the photoreceptor and to minimize wear and damage of the surface layer of the photoreceptor during the image formation, and incomplete cleaning, the amount of the above-mentioned fine inorganic particles is preferably between 0.1 and 100 weight percent, and more preferably between 1 and 50 weight percent of the binder resin of the above-mentioned surface layer. Further, the volume average particle diameter of fine organic and inorganic particles is measured by, for example, a laser diffraction/scatter type particle size distribution measuring apparatus "LA-700" (manufactured by Horiba Seisakusho Co.).

Dioxolan or a derivative thereof are explained.

(Dioxolan or Dioxolan Derivative)

Dioxolan or dioxolan derivative is a cyclic 5-member ether compound and compound having a dioxolan nucleus comprising two oxygen atoms which are not adjacent to each other in the molecule. Specifically, those represented by formula (1) are preferably employed.

Formula (1)

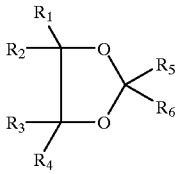

wherein $R_1$ to $R_6$ each represents a hydrogen atom or a substituted or unsubstituted alkyl group having from 1 to 6 carbon atoms. $R_5$ and $R_6$, or at least two groups of $R_1$ to $R_4$ may combine with each other to complete a ring. $R_1$ to $R_6$ each is preferably a hydrogen atom or a substituted or unsubstituted alkyl group having from 1 to 4 carbon atoms. The substituent of the alkyl group includes preferably an alkoxy group having from 1 to 4 carbon atoms, an acyl group, an acyloxy group or a hydroxyl group. Examples of rings which are formed by combining $R_5$ and $R_6$, or at least two groups of $R_1$ to $R_4$, are optional. However, they are preferably 5- to 6-member aromatic rings (for example, a benzene ring) or non-aromatic rings (for example, a cyclohexane ring).

Of these, any of $R_1$ to $R_6$ is preferably a hydrogen atom and further, all $R_1$ to $R_6$ are preferably hydrogen atoms.

The boiling point of dioxolan or a dioxolan derivative is preferably between 70 and 200° C. under normal pressure; more preferably 150° C. or lower, and most preferably between 70 and 130° C.

By employing compounds having the preferred boiling point, the optimum amount of dioxolan or a dioxolan derivative can be incorporated into the surface layer of the photoreceptor employing optimum drying time and thus a uniform coating layer is readily prepared and electric potential during repeated usage is stably maintained.

Specific compound examples are illustrated below.

No.1

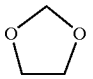

No.2

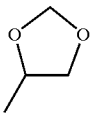

No.3

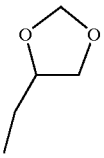

No.4

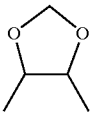

No.5

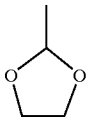

-continued
No.6
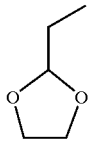
No.7
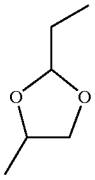
No.8
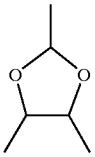
No.9
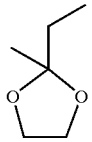
No.10
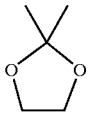
No.11
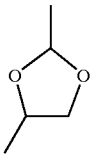
No.12
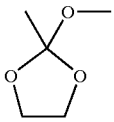
No.13
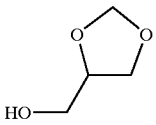
No.14
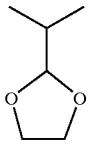
No.15
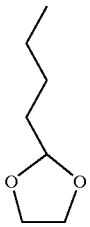
-continued
No.16
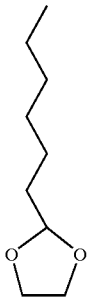
No.17
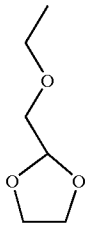
No.18
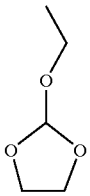
No.19
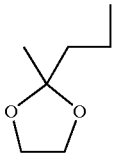
No.20
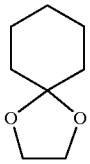
No.21
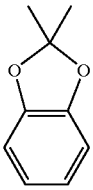
No.22
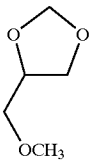

-continued

No.23

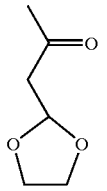

No.24

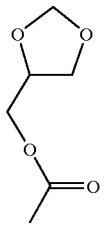

Generally, a photoreceptor is formed in such a way that a subbing layer is provided, if desired, on a conductive support and on the subbing layer, a charge generating layer and a charge transport layer in this order are provided. The charge transport layer is prepared by coating and drying, on the charge generating layer, a coating solution obtained by dissolving a charge transport material and a binder resin to a solvent comprising dioxolan or a dioxolan derivative. Dioxolan or a dioxolan derivative can be incorporated into the charge transport layer by coating and drying the coating solution to form the charge transport layer.

In order to improve cleaning properties of the surface layer of a photoreceptor (herein, a charge transport layer) and wear resistance, and to minimize background staining caused by an increase in residual electric potential during the image formation, the amount of dioxolan or a dioxolan derivative in the charge transport layer is between 0.001 and 10 weight percent of the charge transport layer.

As solvents for the charge transport layer, when dioxolan or a dioxolan derivative is employed in combination with other solvents, are those employed which are excellent in compatibility with dioxolan or a derivative thereof and exhibit high solubility to a binder resin.

(Constitution of the Photoreceptor)

((Photosensitive Layer))

The photoreceptor of the present invention is preferably one in which, on a conductive support, a photosensitive layer comprising an organic photoconductive material is provided, and an organic photoreceptor is particularly preferred in which a charge generating layer comprising a charge generating material and a charge transport layer comprising a charge transport material are formed in this order.

The charge generating layer is prepared by dispersing a charge generating material into a binder resin, if desired. Charge generating materials include metal or metal-free phthalocyanine compounds, azo compounds such as bisazo compounds, trisazo compounds, squarium compounds, azulenium compounds, perylene series compounds, indigo compounds, quinacridone compounds, polycyclic quinone series compounds, cyanine dyes, xanthene dyes, charge transfer complexes consisting of poly-N-vinylcarbazole, trinitrofluorenone, etc. Particularly, are those preferred which are imidazole perylene compounds, one type of perylene compounds exhibiting excellent photoconductive properties and metal phthalocyanine compounds such as titanyl phthalocyanine, gallium phthalocyanine, or hydroxygallium phthalocyanine.

Binder resins which can be employed in the charge generating layer include, for example, polystyrene resins, polyethylene resins, polypropylene resins, polyacryl resins, polymethacryl resins, polyvinyl chloride resins, polyvinyl acetate resins, polyvinyl butyral resins, polyepoxy resins, polyurethane resins, polyphenol resins, polyester resins, polyalkyd resins, polycarbonate resins, polysilicone resins, polymelamine resins, and copolymer resins comprising at least two repeating units or more of these resins such as, for example, vinyl chloride-vinyl acetate copolymer resins, vinyl chloride-vinyl acetate-maleic acid unhydride copolymer resins, or high molecular organic semiconductors such as, for example, poly-N-vinylcarbazole, etc.

The charge transport layer, composed of single charge transport material together, generally, with a binder resin, is provided on the charge generating layer. The charge transport materials include, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene, poly-9-vinylanthracene, etc. These charge transport materials may be employed individually or in combination of two or more.

The charge transport layer is generally composed of the surface layer of a photoreceptor. As the binder resins, mainly employed are silicon atom-containing resins such as siloxane-ester block-copolymers or siloxane-carbonate block-copolymers, etc. described in the above-mentioned Japanese Patent Publication Open to Public Inspection Nos. 3-171056, and 5-113670, and particularly, 8-87119. In addition, mainly employed are fluorine atom-containing polycarbonate resins described in the above-mentioned Japanese Patent Publication Open to Public Inspection Nos. 3-45958 and 5-188638. Other resins mentioned below may be incorporated at about 50 weight percent or less, if desired.

When fine organic particles and/or fine inorganic particles are incorporated into the surface layer of a photoreceptor, other binder resins mentioned below may be employed as a main component. At that time, the polycarbonate series resins mentioned below are preferably employed.

Other resins include, for example, polycarbonates (bisphenol A type polycarbonates, bisphenol Z type polycarbonates), polycarbonate series copolymers, polyester, polyurethane, polystyrene, polystyrene series copolymers, polysiloxane, polyacrylate, polyacrylate series copolymers, phenoxy resins, ABS resin, polyvinyl chloride, polyvinyl chloride series copolymers, polyvinyl acetate series copolymers, polyvinyl formal or polyvinyl butyral, etc.

Particularly preferred conditions of the present invention are that the above-mentioned silicon atom- or fluorine atom-containing binder resin is employed in the surface of a photoreceptor, and further, the above-mentioned fine organic and/or fine inorganic particles are incorporated and in addition, dioxolan or dioxolan derivative of 0.001 to 10 weight percent is incorporated. Utilizing these synergetic effects, photoreceptors can be prepared which exhibit excellent cleaning properties and wear resistance.

Silicone is preferably incorporated into the photosensitive layer, especially into the charge transport layer of the photoreceptor of the present invention.

In addition to the fact that the above-mentioned silicone oil flattens and smoothes the coated surface, it is found that a dioxolan compound incorporated into the photosensitive layer results in the preferred effect. Nitrogen oxides generated during charging are considered to deteriorate the sharpens of images, however, the addition of silicone oil decreases the deterioration in sharpness. Furthermore, the addition of silicone oil is found to prevent the degradation of image quality during operation of numerous sheets.

Silicone oil is dissolved in a dioxolan compound and added to compositions constituting a photosensitive layer.

Preferred silicone oils are those described in Japanese Patent Publication Open to Public Inspection Nos. 54-143643, 57-5050, 57-212453, 59-208556, 63-80262, 1-234854, 4-199154, 5-27456, etc. Particularly, methylphenyl silicone oil and dimethyl silicone oil are preferred, and the added amount is preferably between 10 and 1,000 ppm in the solid portion of the incorporated layer.

Examples of silicone oils are shown below.

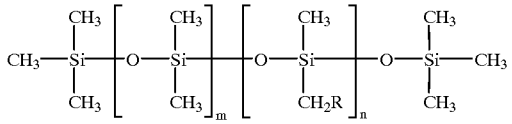

wherein R represents a hydrogen atom, an alkyl group having from 1 to 3 carbon atoms, an alkoxy group having from 1 to 3 carbon atoms, a phenyl group, an alkylphenyl group, an oxyethyl group, an oxypropyl group; m represents an integer of 0 to 2.000, and n represents an integer of 0 to 2.000.

Specifically, included are dimethylsilicone oil (SH200, manufactured by Toray Silicone Co.; KF96, manufactured by Shin-Etsu Kagaku Kogyo Co.; TSF451, manufactured by Toshiba Silicone Co.) and methylphenylsilicone oil (SH510, manufactured by Toray Silicone Co.; KF50, manufactured by Shin-Etsu Kagaku Kogyo Co.; TSF431, manufactured by Toshiba Silicone Co.). Those in which R in the above-mentioned general formula is modified with a functional group are employed such as alkyl-modified silicone, alkylaryl-modified silicone, alkoxy-modified silicone, alcohol-modified silicone, amine-modified silicone, oxyalkyl-modified silicone, fluorine-modified silicone, glycol-modified silicone, polyether-modified silicone, fatty acid ester-modified silicone, etc.

Specific examples are shown below.

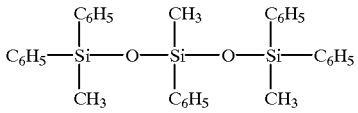

(methylphenylsilicon oil)

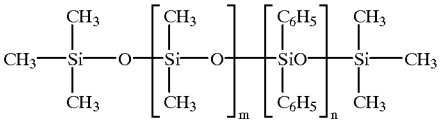

(dimethyl-diphenyl-copolymerized silicone oil)

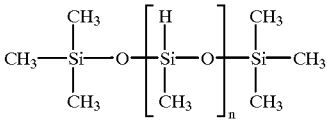

(methylsilicon oil)

Selected as silicone oil incorporated into the above-mentioned charge transport layer and charge generating layer according to the present invention are, for example, alkylslicone oil, arylsilicone oil, alkylarylsilicone oil, etc. Methylphenyl silicone oil is excellent, and one having a content ratio of the phenyl group of 10 to 25 percent is particularly excellent. Such silicone oils are commercially available, and KF-50, KF-54, and KF-56, manufactured by Shin-Etsu Kagaku Kogyo Co., and TSF431, TSF443, and TSF437, manufactured by Toray Silicone Co., etc., for example, are preferably employed.

In order to minimize fatigue degradation during repeated usage of a photoreceptor or to improve the durability, incorporated into any layer constituting the photosensitive layer of the photoreceptor, may be if desired, the optimum added amount of ambient dependence-minimizing agents such as antioxidants, electron accepting materials, surface improving agents, plasticizers, etc., known in the art.

Examples of antioxidants preferably employed include, for example, those having a hindered-amine structure unit or a hindered-phenol structure unit, or those having both, organic phosphorus series compounds, organic sulfur series compounds, hydroquinone series compounds, phenylamine series compounds, etc.

(1) Exemplified Compounds Having a Hindered-Phenol Structure Unit 1-1

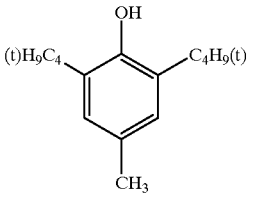

1-2

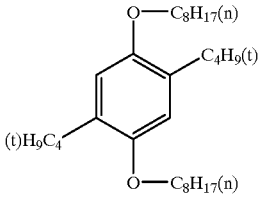

-continued
1-3
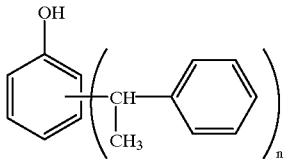
1-4
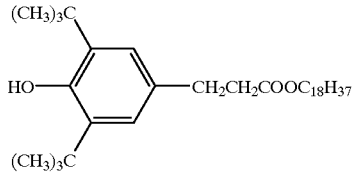
1-5
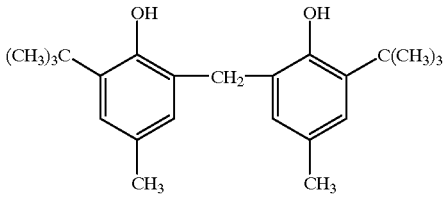
1-6
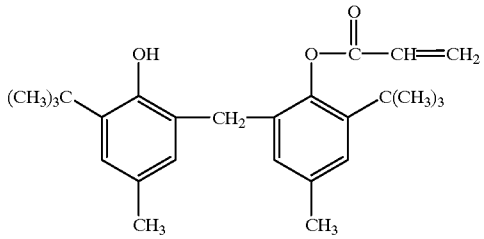
1-7
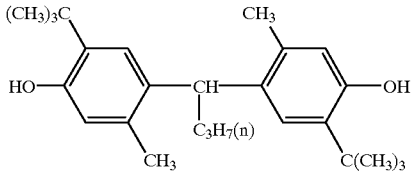
1-8
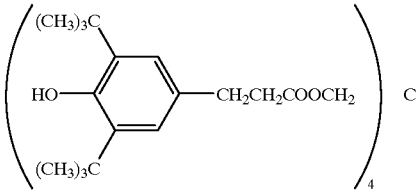
1-9
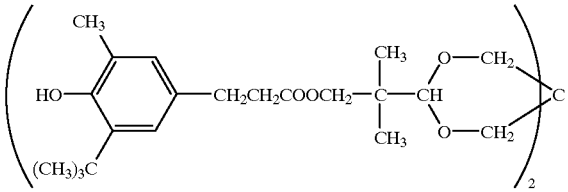
1-10
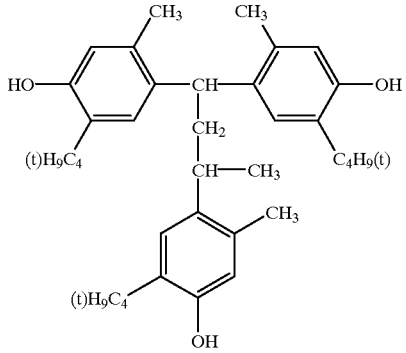
1-11
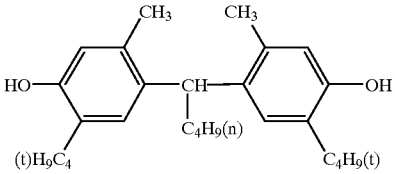
1-12
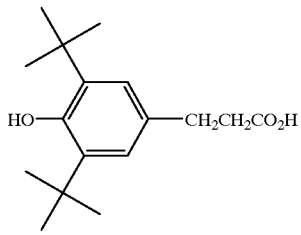

-continued
1-13
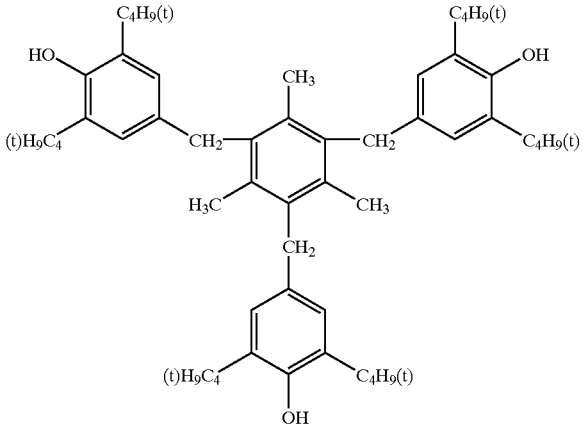
1-14
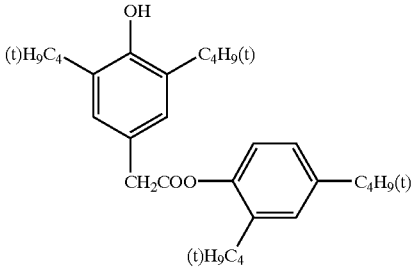
1-15
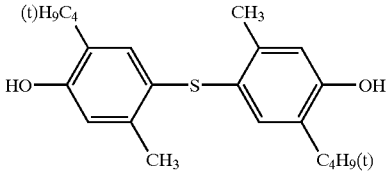
1-16
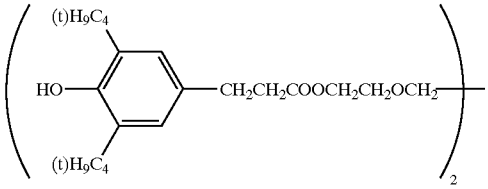
1-17
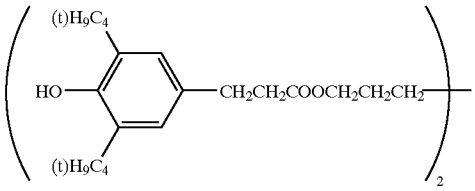
1-18
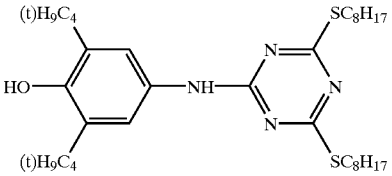
1-19
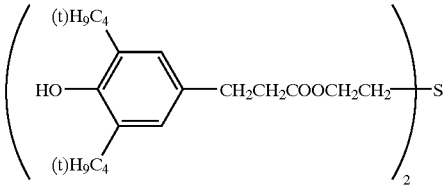
1-20
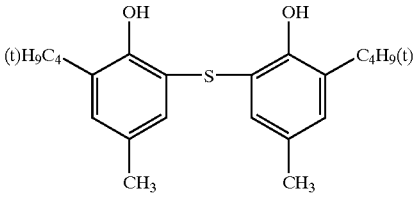
1-21
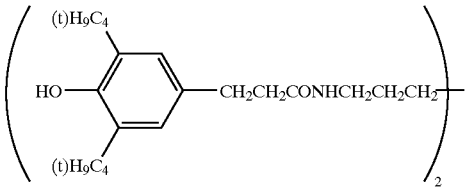
1-22
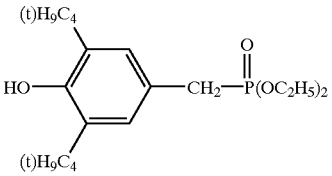
1-23
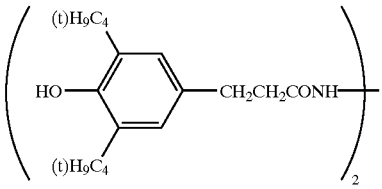
1-24
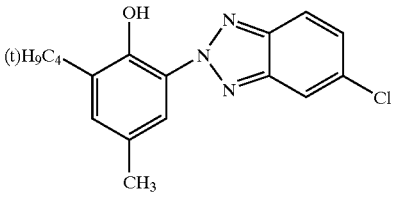

-continued
1-25
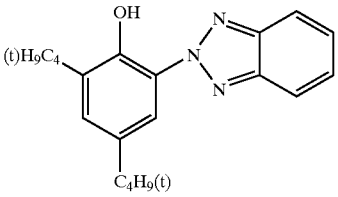
1-26
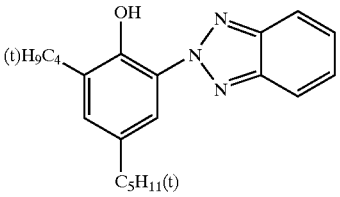
1-27
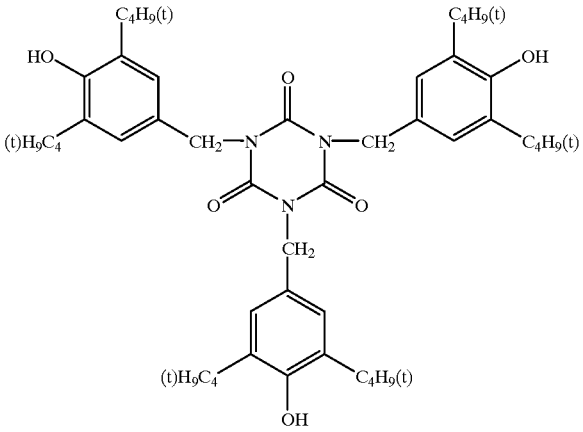
1-28
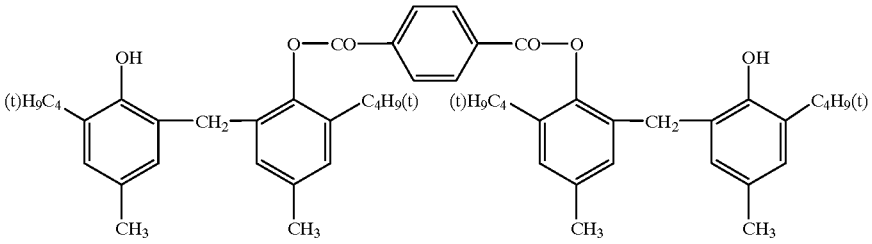
1-29
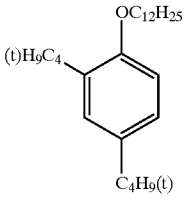
1-30
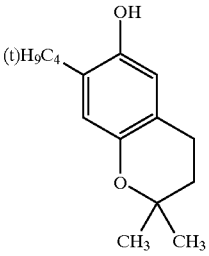
1-31
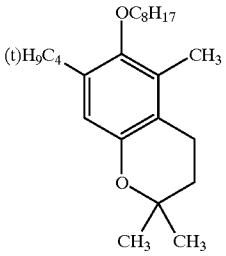

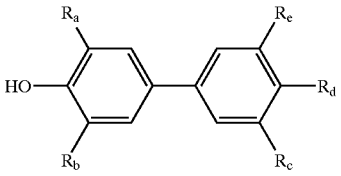
| | $R_a$ | $R_b$ | $R_c$ | $R_d$ | $R_e$ |
|---|---|---|---|---|---|
| 1-32 | Bu(t) | Bu(t) | H | H | H |
| 1-33 | Bu(t) | Bu(t) | H | $CH_3$ | H |
| 1-34 | Bu(t) | Bu(t) | Bu(t) | H | Bu(t) |
| 1-35 | Bu(t) | Bu(t) | Bu(t) | OH | Bu(t) |
| 1-36 | Bu(t) | H | H | H | H |
| 1-37 | $C_5H_{11}$(t) | $C_5H_{11}$(t) | H | H | H |
| 1-38 | $C_5H_{11}$(t) | H | H | H | H |
| 1-39 | Bu(t) | $CH_3$ | H | H | H |
1-40
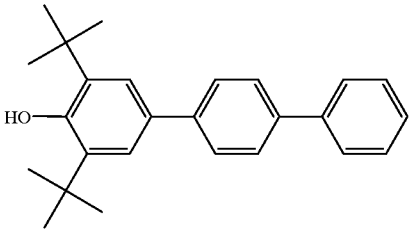
1-41
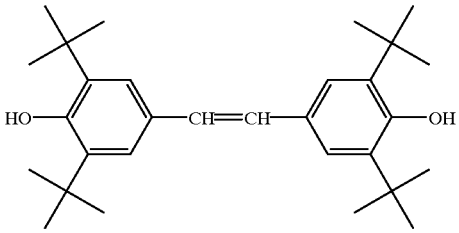
1-42
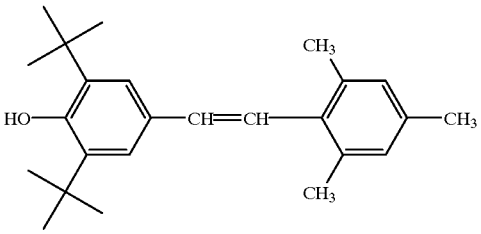
1-43
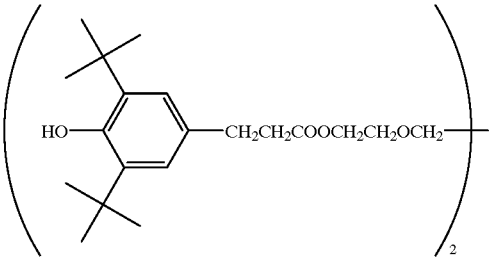
-continued
1-44
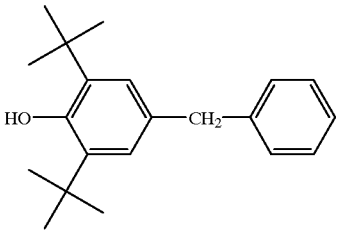
1-45
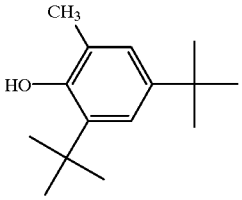
1-46
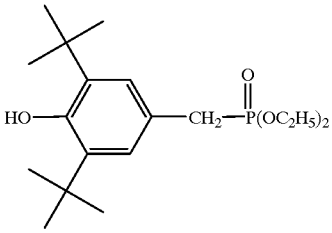
1-47
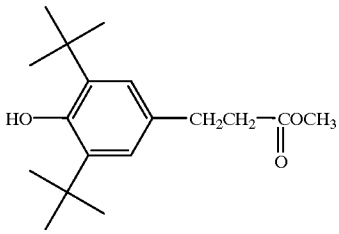
1-48
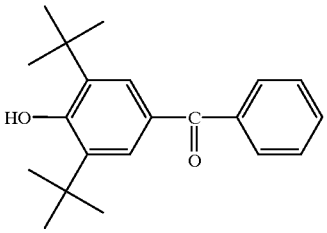
1-49
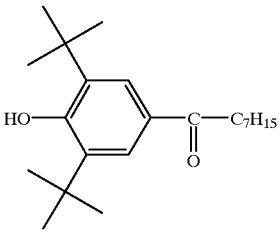

-continued
1-50
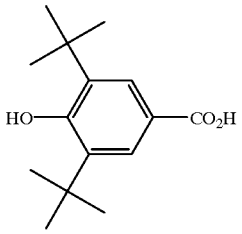
1-51
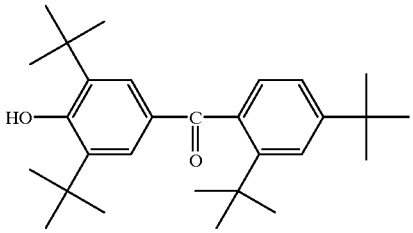
1-52
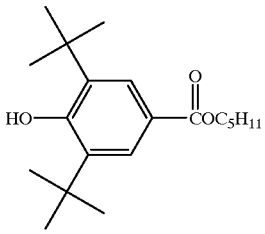
1-53
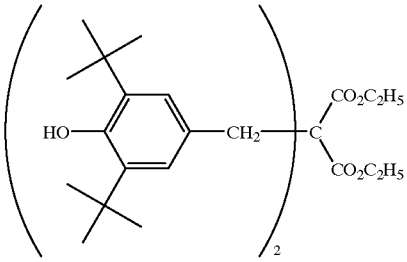
1-54
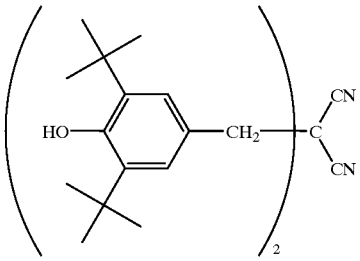
1-55
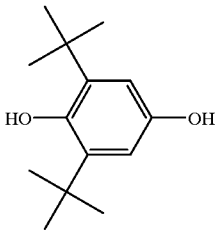
-continued
1-56
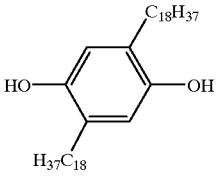
1-57
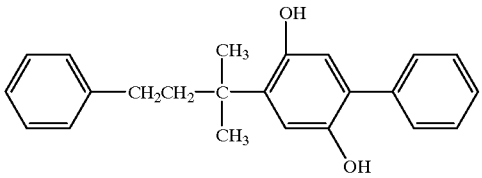
1-58
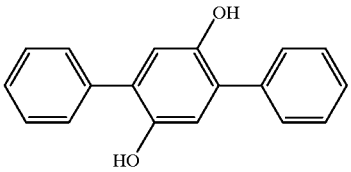
1-59
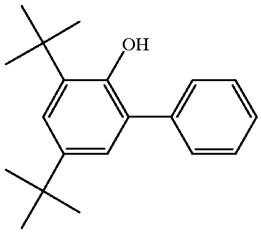
1-60
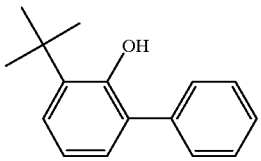
1-61
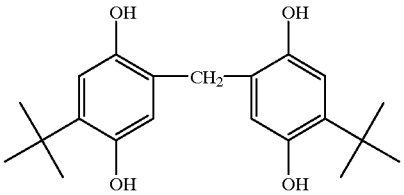
1-62
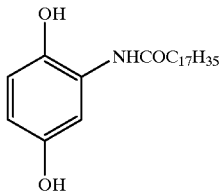

-continued
1-63
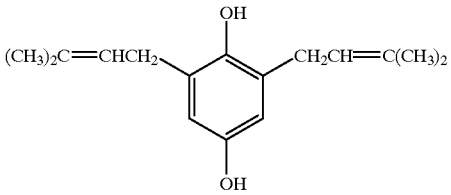
(2) Exemplified Compounds Having Hindered-Amine Structure Unit and a Hindered-Phenol Structure Unit
2-1
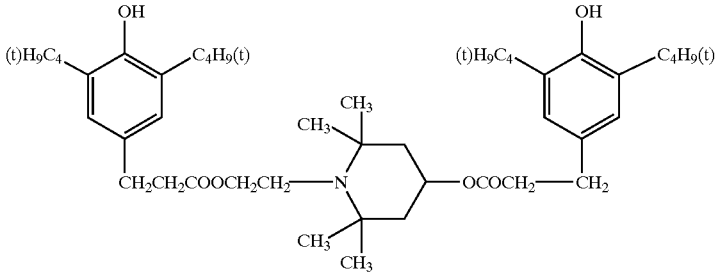
2-2
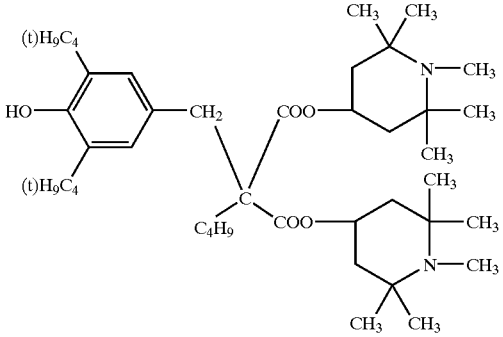
2-3
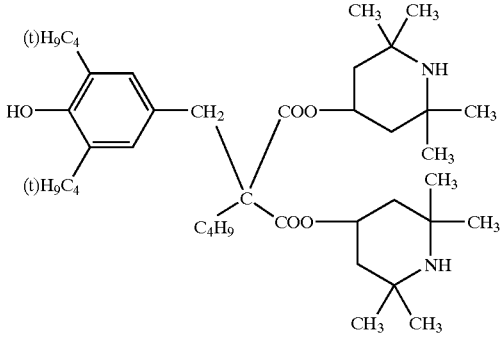
2-4
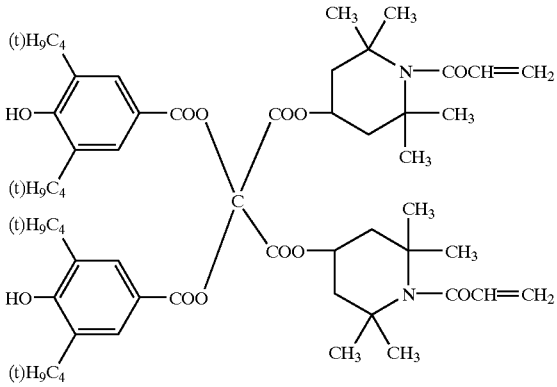
2-5
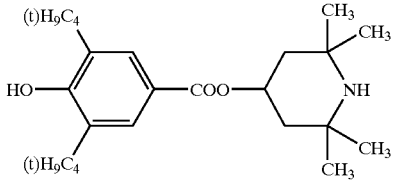
2-6
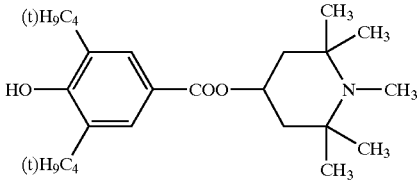

-continued
2-7
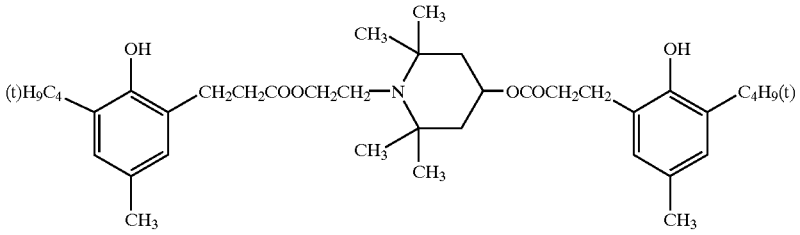
2-8
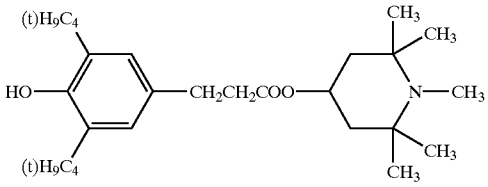
2-9
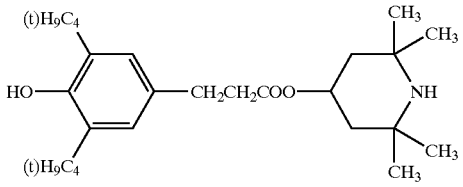
2-10
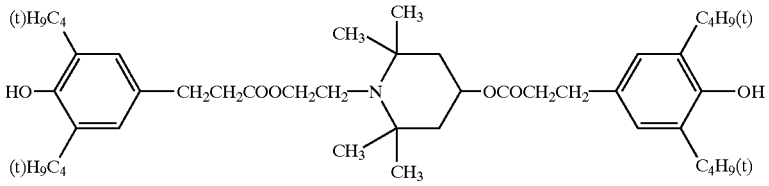
(3) Exemplified Compounds Having a Hindered-Amine Structure Unit
3-1
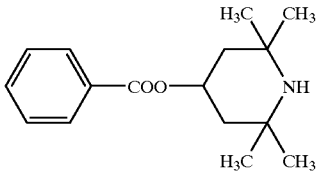
3-2
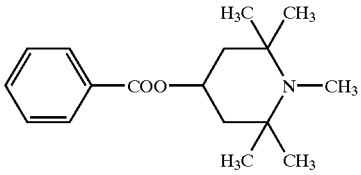
3-3
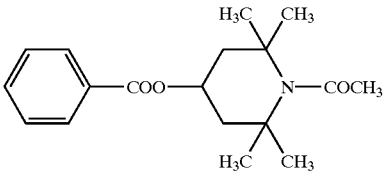
3-4
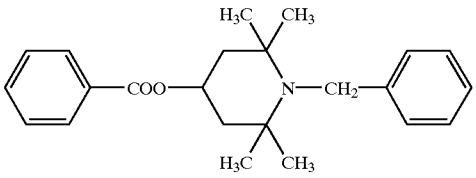
-continued
3-5
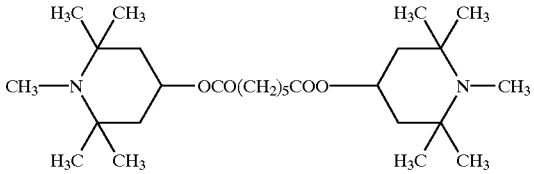
3-6
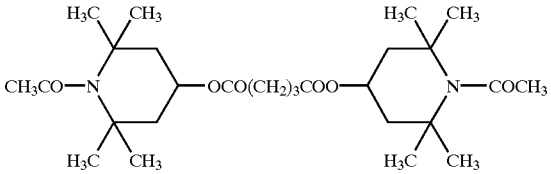
3-7
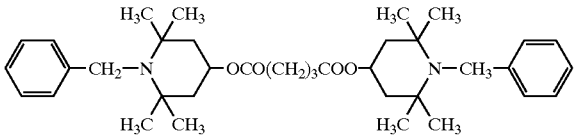
3-8
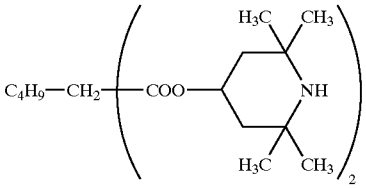

-continued
3-9
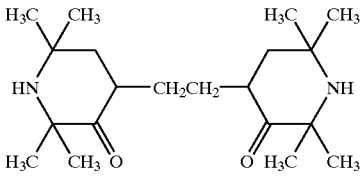
3-10
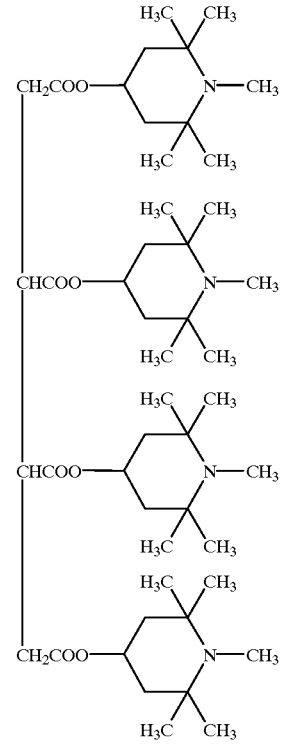
3-11
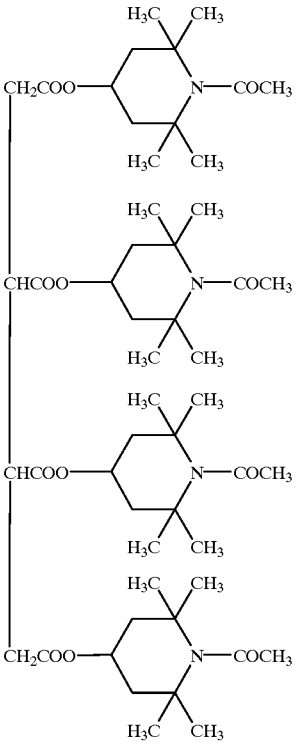
(4) Examples of Phosphorous Series Compounds
These are compounds, for example, represented by general formula RO—P(OR)—OR, wherein the Rs each represents a hydrogen atom, or a substituted or unsubstituted alkyl, alkenyl or aryl group. Representative compounds include the following:
4-1
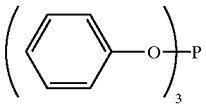
4-2
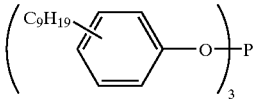
4-3
$(C_2H_5O)_3P$
4-4
$(C_8H_{17})_3P$
4-5
$(C_{10}H_{21}O)_3P$
4-6
$(C_{13}H_{27}O)_3P$
4-7
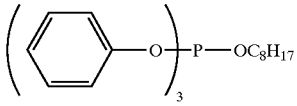
4-8
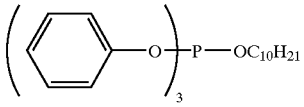
4-9
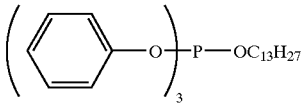
4-10
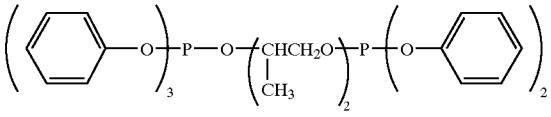
4-11
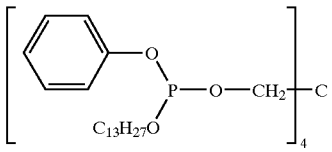
4-12
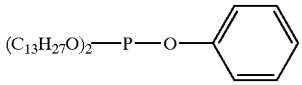
4-13
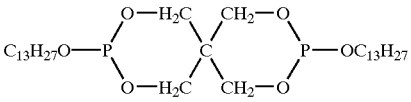
4-14
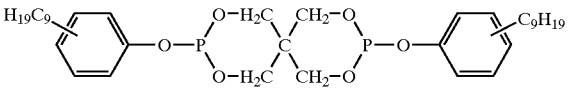
4-15
$(C_{18}H_{35}O)_3P$ -continued 4-16

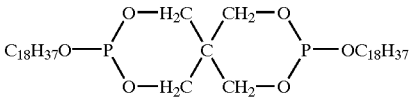

4-17

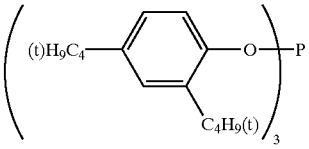

4-18

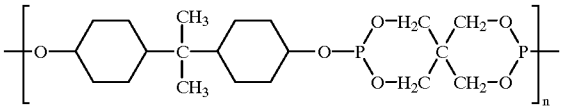

(5) Organic Sulfur Series Compounds

These are compounds, for example, represented by general formula R—S—R, wherein each R represents a hydrogen atom, or a substituted or unsubstituted alkyl, alkenyl or aryl group. The representative compounds include the following:

5-1 $(C_8H_{17}OCOCH_2CH_2)_2S$ 5-2 $(C_{10}H_{21}OCOCH_2CH_2)_2S$ 5-3 $(C_{12}H_{25}OCOCH_2CH_2)_2S$ 5-4 $(C_{14}H_{29}OCOCH_2CH_2)_2S$ 5-5 $(C_{18}H_{37}OCOCH_2CH_2)_2S$ 5-6

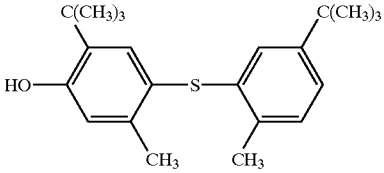

(6) Hydroquinone Series Compounds

Hydroquinone series compounds include, for example, compounds represented by the general formula below.

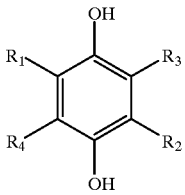

wherein $R_1$ to $R_4$ each represents a substituent such as an alkyl group, a benzyl group, an aralkyl group, etc. Each represents a substituted or unsubstituted alkyl, alkenyl or aryl group.

Representative compounds include the following:

6-1

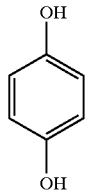

6-2

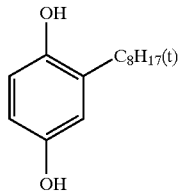

6-3

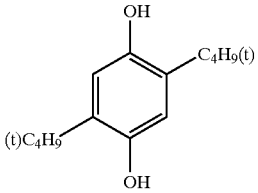

6-4

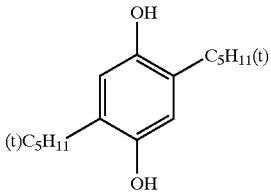

6-5

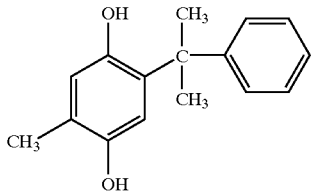

6-6

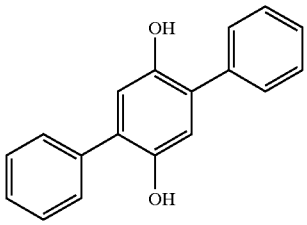

6-7

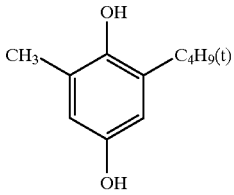

-continued 6-8

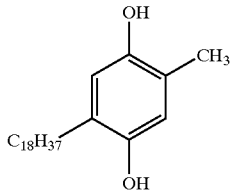

6-9

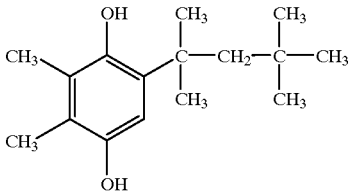

6-10

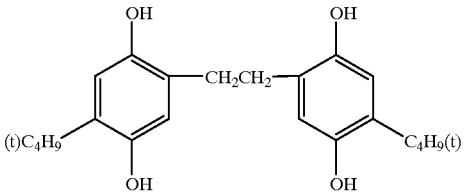

(7) Phenylamine Series Compounds

Phenylamine series compounds include, for example, those represented by the general formula below.

$$Ar—NH—R_6$$

wherein Ar represents an aryl group, and $R_6$ represents a substituent such as an alkyl group, an aryl group, a benzyl group, etc.

Representative compounds include, for example, the following:

7-1

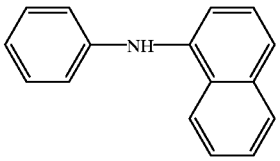

7-2

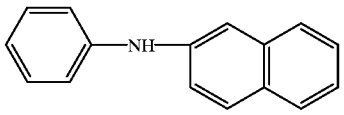

7-3

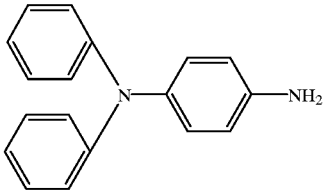

-continued 7-4

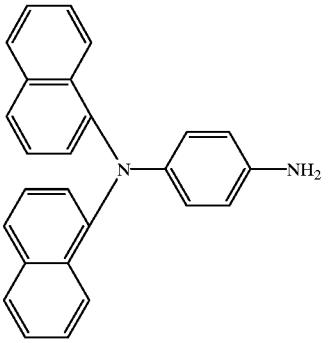

As preferred antioxidants, those having a hindered-phenol group in the molecule are advantageous in terms of the stability of a coating composition, properties of a photoreceptor repeatedly employed, and potential stability. A mixture consisting of different types of antioxidants may be employed.

In order to secure the storage stability of the solvent and repeated properties of electrophotography, the added amount of antioxidants is preferably between 20 ppm and 5 percent and more preferably between 50 ppm and 3 percent of a coating composition. The added amount is preferably between 0.001 and 10 percent and more preferably between 0.01 and 5 percent of the solid portion of the dried coating layer.

In order to improve durability, a non-photosensitive layer, such as a protective layer, other than the photosensitive layer may be provided, if desired. The above-mentioned charge transport material is incorporated into this layer and a photoreceptor comprising a so-called plural layer type charge transport layer may be prepared.

In order to constitute the surface layer of a photoreceptor, physical property improving agents (such as silicon atom- or fluorine atom-containing binder resin, fine organic particles and/or fine inorganic particles) are incorporated into the above-mentioned protective layer or upper charge transport layer, of a plural-layer type charge transport layer, and dioxolan or a dioxolan derivative of 0.001 to 10 weight percent is retained in the same as in the case for a photoreceptor having two layers, prepared by coating a charge transport layer on the above-mentioned charge generating layer. By such constitution, the photoreceptor exhibits excellent cleaning properties and wear resistance.

Furthermore, in addition to these, spectral sensitivity correcting dyes may be incorporated into the photoreceptor of the present invention. Additives such as antioxidants, etc. may be incorporated into the photoreceptor in combination with these.

There are various methods to coat a photosensitive composition to form a photoreceptor. Specifically, a circular amount controlling type coating device, especially a slide hopper type coating device, is preferable. These techniques are described in each of Japanese Patent Publication Open to Public Inspection Nos. 58-189061, 8-318209 or 9-10654.

((Subbing Layer, Support))

Furthermore, when a subbing layer is provided, a resin-based subbing layer employing polyamide series compounds such as nylon, etc., or a so-called ceramic based subbing layer (referred to as a hardened subbing layer) employing an organic metal compound, and silane coupling agents is preferably employed.

Still further, employed as conductive supports for the above-mentioned photosensitive layer, may be a metal plate or metal drum composed of aluminum, nickel, etc., plastic film or a plastic drum spattered with aluminum, tin oxide, indium oxide, etc., or paper, plastic film or a plastic drum coated with a conductive material.

The present invention is explained with specific reference to examples. However, the embodiment of the present invention is not limited to the examples.

EXAMPLES

Example 1

(Preparation of Photoreceptor 1)

As a conductive support, an aluminum support having a diameter of 80 mm and a height of 355 mm was employed, which was subjected to mirror surface finishing.

On the above support, a subbing layer coating composition UCL-1, mentioned below, was coated and a subbing layer of a dried thickness of 0.8 μm, was formed.

Further, in coating of each photoreceptor below, a slide hopper type coating device, one type of a circular amount controlling type coating device, was employed for each.

((Subbing Layer Coating Composition UCL-1))

| | |
|---|---|
| Copolymer nylon "CM 8000" (manufactured by Toray Co.) | 2 g |
| Methanol/butanol = 10/1 | 1,000 ml |

Subsequently, on the above-mentioned subbing layer, the charge generating layer coating composition CGL-1 was applied and dried, and a charge generating layer having a dried layer thickness of 1.5 μm was prepared.

((Charge Generating Layer Coating Composition CGL-1))

| | |
|---|---|
| Fluorenone type disazo pigment (CGM-1) having the structure described below | 25 g |
| Butyral "Eslex BX-L" (manufactured by Sekisui Kagaku Co.) | 10 g |
| 2-Butanone | 1,430 ml |

The above-mentioned composition was dispersed for 20 hours employing a sand mill and the resultant was employed as a coating composition.

CGM-1

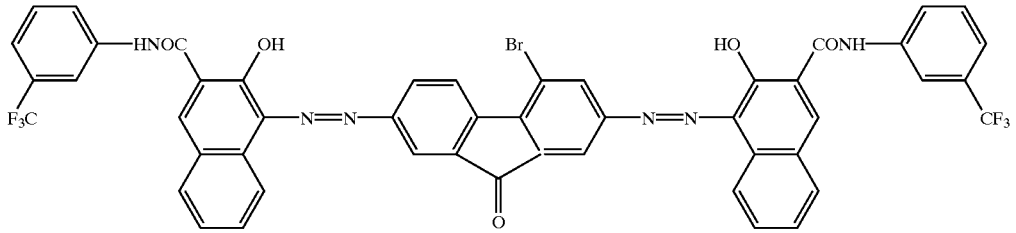

Subsequently, on the above-mentioned charge generating layer, the charge transport layer coating composition CTL-1 was applied and then dried at 100° C. for one hour. The charge transport layer having a dried layer thickness of 23 μm was provided on the coated layer and Photoreceptor 1 of the present invention was prepared. At that time, the amount of Compound Example No. 1 remaining in the photosensitive layer was 1.0 weight percent.

((Charge Transport Layer Coating Composition CTM-1))

| | |
|---|---|
| Charge transfer Material CTM-1 having the structure described below | 420 g |
| Siloxane-copolymerized polycarbonate B-1 having the structure described below (viscosity average molcular weight = 40,000) | 560 g |
| Compound Example No. 1 | 2,800 ml |

CTM-1

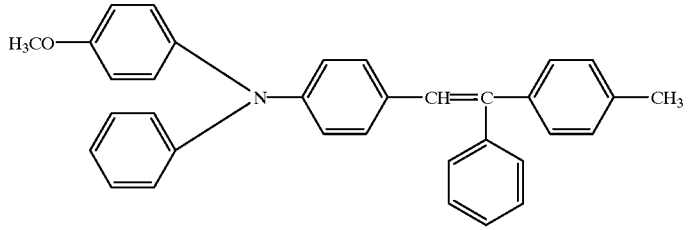

-continued

B-1

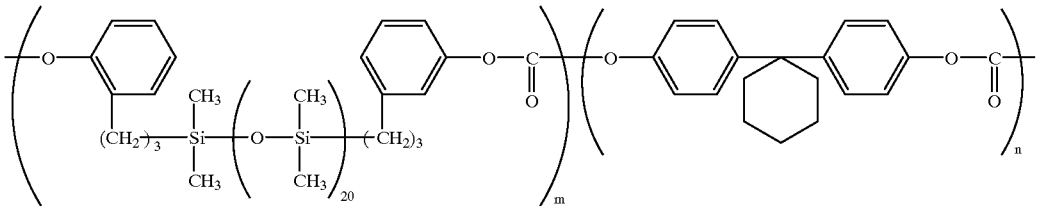

m:n = 20:80 Mv = 40,000

(Preparation of Photoreceptor 2)

Photoreceptor 2 of the present invention was prepared in the same way as Photoreceptor 1, except that in Photoreceptor 1, the charge transport layer was dried at 120° C. instead of 100° C. At that time, the amount of Compound Example No. 1 remaining in the photosensitive layer was 0.01 weight percent of the photosensitive layer.

(Preparation of Photoreceptor 3)

Photoreceptor 3 was prepared in the same manner as Photoreceptor 1, except that the charge transport layer was dried at 90° C. instead of 100°.

At that time, the amount of Compound Example No. 1 remaining in the photosensitive layer was 3.5 weight percent of the photosensitive layer.

(Preparation of Photoreceptor 4)

Photoreceptor 4 of the present invention was prepared in the same manner as Photoreceptor 1, except that in Photoreceptor 1, the binder resin of the charge transport layer, siloxane-copolymerized carbonate B-1, was replaced with to siloxane-coplymerized carbonate B-2 (having a viscosity average molecular weight Mv=20,000) of the following structure. At that time, the residual amount of Compound No. 1 in the photosensitive layer was 1.2 weight percent of the photosensitive layer.

B-3

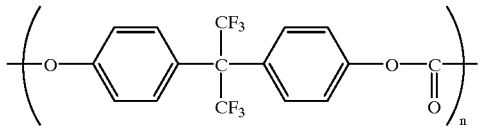

Mv = 30,000

(Preparation of Photoreceptor 6)

As a conductive support, was an aluminum support having a diameter of 80 mm and a height of 355 mm, which was subjected to mirror surface finish, employed.

On the above-mentioned support, the subbing layer coating composition UCL-1 mentioned below was applied and a subbing layer with a dried layer thickness of 1.0 $\mu$m was formed.

B-2

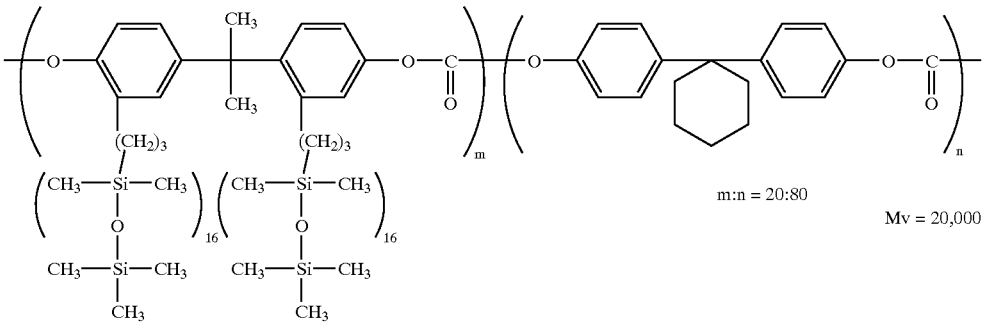

m:n = 20:80

Mv = 20,000

(Preparation of Photoreceptor 4)

Photoreceptor 5 of the present invention was prepared in the same manner as for Photoreceptor 1, except that in Photoreceptor 1, the binder resin of the charge transport layer, siloxane-copolymerized carbonate B-1 was replaced with fluorine atom-containing carbonate B-3 (having a viscosity average molecular weight Mv=30,000) of the following structure. At that time, the amount of Compound Example No. 1 in the photosensitive layer was 1.2 weight percent of the photosensitive layer.

((Subbing Layer Coating Composition UCL-2))

| | |
|---|---|
| Titanium chelate compound "TC-750" (manufactured by Matsumoto Seiyaku Co.) | 30 g |
| Silane coupling agent "KBM-503) (manufactured by Shin-Etsu Kagaku Co.) | 17 g |
| 2-Propanol | 150 ml |

Subsequently, on the above-mentioned subbing layer, the charge generating layer coating composition CGL-2 was dispersed and coated, so as to form a layer thickness of 0.5 μm.

((Charge Generating Layer Coating Composition CGL-2))

| | |
|---|---|
| Y type titanyl phthalocyanine | 10 g |
| Silicone resin "KR-5240" (manufactured by Shin-Etsu Kagaku Co.) | 10 g |
| t-Butyl acetate | 1,000 ml |

The above composition was dispersed for 20 hours employing a sand mill, and subsequently employed as a coating composition. Thereafter, on the above charge generating layer, the charge transport layer coating composition CTL-2 mentioned below was applied and dried for one hour to form a charge transport layer having a dried layer thickness of 23 μm. Thus, Photoreceptor 6 of the present invention was prepared. At that time, the total amount of Compound Examples No. 1 and No. 2 remaining in the photosensitive layer was 1.5 weight percent of the photosensitive layer.

(Charge Transport Layer Coating Composition CTL-2))

| | |
|---|---|
| Charge transport material CTM-1 | 420 g |
| Siloxane-copolymerized polycarbonate B-1 | 660 g |
| Compound Example No. 1 | 2,600 ml |
| Compound Example No. 2 | 200 ml |

(Preparation of Photoreceptor 7)

On the conductive support, in the same manner as for Photoreceptor 6, a subbing layer and a charge generating layer were successively provided, and on the charge generating layer, the charge transport layer coating composition CTL-3 was coated and dried at 100° C. for 30 minutes to form a charge transport layer having a dried layer thickness of 23 μm. Thus, Photoreceptor 7 of the present invention was prepared. At that time, the total amount of Compound Examples No. 1 and No. 2 remaining in the photosensitive layer was 1.5 weight percent of the photosensitive layer.

((Charge Transport Layer Coating Composition CTL-3))

| | |
|---|---|
| Charge Transport Material CTM-1 | 420 g |
| Siloxane-copolymerized polycarbonate B-1 | 660 g |
| Dichloromethane | 2,500 ml |
| Compound Example No. 1 | 270 ml |
| Compound Example No. 2 | 30 ml |

(Preparation of Photoreceptor 8)

Photoreceptor 8 of the present invention was prepared in the same way as Photoreceptor 6, except that in Photoreceptor 6, the binder resin of the charge transport layer, siloxane-copolymerized polycarbonate B-1 was replaced with siloxane-copolymerized polycarbonate B-2. At that time, the total amount of Compound Examples No. 1 and No. 2 remaining in the photosensitive layer was 1.2 weight percent of the photosensitive layer.

(Preparation of Photoreceptor 9)

In the same manner as for Photoreceptor 6, a subbing layer and a charge generating layer are successively provided on the conductive support, and on the charge generating layer, the charge transport layer coating composition CTL-4 was applied and dried at 100° C. for one hour to form a charge transport layer having a dried layer thickness of 23 μm, and thus Photoreceptor 9 of the present invention was prepared. At that time, the amount of Compound Example 1 remaining in the photosensitive layer was 1.0 weight percent of the photosensitive layer.

((Charge Transport Layer Coating Composition CTL-4))

| | |
|---|---|
| Charge transport material CTM-1 | 420 g |
| Polycarbonate "Z 200" (manufactured by Mitsubishi Gas Kagaku Co.) | 660 g |
| Polytetrafluoroethylene PTFE "Ruburon L 2" (manufactured by Daikin Co.) | 132 g |
| Dispersing aid "GF-300 (purified) (manufactured by Toa Gosei Co.) | 13.2 g |
| Compound Example No. 1 | 2,800 ml |

The above composition was dispersed for three hours employing a sand mill and subsequently employed as a coating composition.

(Preparation of Photoreceptor 10)

Photoreceptor 10 of the present invention was prepared in the same manner as Photoreceptor 9, except that in Photoreceptor 9, the binder resin in the charge transport layer, polycarbonate "Z 200" was replaced with siloxane-copolymerized polycarbonate B-1. At that time, the amount of Compound Example No. 1 remaining in the photosensitive layer was 1.0 weight percent of the photosensitive layer.

(Preparation of Photoreceptor 11)

In the same manner as for Photoreceptor 6, on an aluminum support, a subbing layer and a charge generating layer were successively provided, and on the charge generating layer, the charge transport layer coating composition CTL-5 was applied and dried at 100° C. for one hour to form a charge transport layer having a dried layer thickness of 23 μm. Thus, Photoreceptor 11 of the present invention was prepared. At that time, the amount of Compound Example No. 1 remaining in the photosensitive layer was 1.0 weight percent of the photosensitive layer.

(Charge Transport Layer Coating Composition CTL-5)

| | |
|---|---|
| Charge transport material CTM-1 | 420 g |
| Polycarbonate "Z 200" | 660 g |
| Fine tin oxide particles (average particle diameter: 0.5 μm) | 66 g |
| Compound Example No. 1 | 2,800 ml |

The above composition was dispersed for three hours and subsequently employed as a coating composition.

(Preparation of Photoreceptor 12)

In the same manner as for Photoreceptor 11, on an aluminum support, a subbing layer and a charge generating layer are successively provided, and on the charge generating layer, the charge transport layer coating composition CTL-6 mentioned below was applied and dried at 100° C. for one hour to form a charge transport layer having a dried layer thickness of 23 μm. Thus, Photoreceptor 12 of the present invention was prepared. At that time, the amount of Compound Example No. 1 remaining in the photosensitive layer was 1.0 weight percent of the photosensitive layer.

((Charge Transport Layer Coating Composition CTL-6))

| | |
|---|---|
| Charge transport material CTM-1 | 20 g |
| Siloxane-copolymerized polycarbonate B-1 | 660 g |
| Fine tin oxide particles (average particle diameter: 0.5 μm) | 66 g |
| Compound Example No. 1 | 2,800 ml |

The above composition was dispersed for three hours and subsequently employed as a coating composition.

(Preparation of Photoreceptor 13)

In the same manner as for Photoreceptor 11, on an aluminum support, a subbing layer and a charge generating layer are successively provided, and on the charge generating layer, the charge transport layer coating composition CTL-7 mentioned below was applied and dried at 100° C. for one hour to form a charge transport layer having a dried layer thickness of 23 μm. Thus, Photoreceptor 13 of the present invention was prepared. At that time, the amount of Compound Example No. 1 remaining in the photosensitive layer was 1.0 weight percent of the photosensitive layer.

((Charge Transport Layer Coating Composition CTL-7))

| | |
|---|---|
| Charge transport material CTM-1 | 420 g |
| Siloxane-copolymerized polycarbonate B-1 | 660 g |
| Silica "Admafine S-C1" (manufactured by Admatex Co.) | 66 g |
| Compound Example No. 1 | 2,800 ml |

The above composition was dispersed for three hours and subsequently employed as a coating composition.

(Preparation of Photoreceptor 14)

In the same manner as for Photoreceptor 11, on an aluminum support, a subbing layer and a charge generating layer are successively provided, and on the charge generating layer, the charge transport layer coating composition CTL-8 mentioned below was applied and dried at 100° C. for one hour to form a charge transport layer having a dried layer thickness of 23 μm. Thus, Photoreceptor 14 of the present invention was prepared. At that time, the amount of Compound Example No. 1 remaining in the photosensitive layer was 1.0 weight percent of the photosensitive layer.

((Charge Transport Layer Coating Composition CTL-8))

| | |
|---|---|
| Charge transport material CTM-1 | 420 g |
| Siloxane-copolymerized polycarbonate B-1 | 660 g |
| Fine tin oxide particles (average particle diameter: 0.5 μm) | 66 g |
| PTFE "Ruburon L2" | 132 g |
| Compound Example No. 1 | 2,800 ml |

The above composition was dispersed for three hours and subsequently employed as a coating composition.

(Preparation of Photoreceptor 15)

Photoreceptor 15 of the present invention was prepared in the same way as Photoreceptor 1, except that in Photoreceptor 1, the charge transport layer was dried at 130° C. instead of 100° C. At that time, the amount of Compound Example No. 1 remaining in the photosensitive layer was 0.0001 weight percent of the photosensitive layer.

(Preparation of Photoreceptor 16)

The Photoreceptor 16 was prepared in the same manner as for Photoreceptor 1, except that the drying temperature for the charge transport layer was dried at 60° C. instead of 100° C. At that time, the amount of Compound Example No. 1 remaining in the photosensitive layer was 12.5 weight percent of the photosensitive layer.

(Preparation of Photoreceptor 17)

In the same manner as for Photoreceptor 1, on an aluminum support, a subbing layer and a charge generating layer are successively provided, and on the charge generating layer, the charge transport layer coating composition CTL-9 mentioned below was applied and dried at 100° C. for one hour to form a charge transport layer having a dried layer thickness of 23 μm. Thus, Comparative Photoreceptor 17 was prepared. At that time, the amount of 1,2-dichloroethane remaining in the photosensitive layer was 1.0 weight percent of the photosensitive layer.

((Charge Transport Layer Coating Composition CTL-9))

| | |
|---|---|
| Charge transport material CTM-1 | 420 g |
| Siloxane-copolymerized polycarbonate B-1 | 560 g |
| 1,2-Dichloroethane | 2,800 ml |

(Preparation of Photoreceptor 18)

In the same manner as for Photoreceptor 1, on an aluminum support, a subbing layer and a charge generating layer are successively provided, and on the charge generating layer, the charge transport layer coating composition CTL-10 mentioned below was applied and dried at 100° C. for one hour to form a charge transport layer having a dried layer thickness of 23 μm. Thus, Comparative Photoreceptor 18 was prepared. At that time, the amount of Compound Example No. 1 remaining in the photosensitive layer was 1.0 weight percent of the photosensitive layer.

((Charge Transport Layer Coating Composition CTL-10))

| | |
|---|---|
| Charge transport material CTM-1 | 420 g |
| Polycarbonate "Z 200" | 560 g |
| Compound Example No. 1 | 2,800 ml |

(Preparation of Photoreceptor 19)

Comparative Photoreceptor 19 was prepared in the same manner as Photoreceptor 9, except that in the Photoreceptor 14, the solvent in the charge transport coating composition, Compound Example No. 1 was replaced with 1,2-dichloroethane. At that time, the amount of 1,2-dichloroethane remaining in the photosensitive layer was 1.1 weight percent of the photosensitive layer.

TABLE 1

| Photo-receptor No. | Charge Transport Layer (Surface Layer) Binder Resin (Viscosity Average Molecular Weight Mv) | Kind of Solvent (volume in ml) | Fine Organic Particles | Fine Inorganic Particles | Drying Conditions | Amount of Dioxolan Series Solvent Remaining in Photosensitive Layer (weight percent) |
|---|---|---|---|---|---|---|
| 1 | B-1 (40,000) | No.1 (2800) | — | — | 100° C., 1 hour | 1.0 |
| 2 | B-1 (40,000) | No.1 (2800) | — | — | 120° C., 1 hour | 0.01 |
| 3 | B-1 (40,000) | No.1 (2800) | — | — | 90° C., 1 hour | 3.5 |
| 4 | B-2 (20,000) | No.1 (2800) | — | — | 100° C., 1 hour | 1.2 |
| 5 | B-3 (30,000) | No.1 (2800) | — | — | 100° C., 1 hour | 1.2 |
| 6 | B-1 | No.1 (2600) No.2 (200) | — | — | 100° C., 1 hour | 1.5 |
| 7 | B-1 | Dichloromethane (2500) No.1 (270), No.2 (30) | — | — | 100° C., 30 minutes | 1.2 |
| 8 | B-2 | No.1 (2600) No.2 (200) | — | — | 100° C., 1 hour | 1.0 |
| 9 | Polycarbonate "Z200" | No.1 (2800) | PTFE | — | 100° C., 1 hour | 1.0 |
| 10 | B-1 | No.1 (2800) | PTFE | — | 100° C., 1 hour | 1.0 |
| 11 | Polycarbonate "Z200" | No.1 (2800) | — | Fine Tin Oxide Particles | 100° C., 1 hour | 1.0 |
| 12 | B-1 | No.1 (2800) | — | Fine Tin Oxide Particles | 100° C., 1 hour | 1.0 |
| 13 | B-1 | No.1 (2800) | — | Silica | 100° C., 1 hour | 1.0 |
| 14 | B-1 | No.1 (2800) | PTFE | Fine Tin Oxide Particles | 100° C., 1 hour | 1.0 |
| 15 | B-1 | No.1 (2800) | — | — | 130° C., 1 hour | 0.0001 |
| 16 | B-1 | No.1 (2800) | — | — | 60° C., 1 hour | 12.5 |
| 17 | B-1 | 1,2-dichloroethane (2800) | — | — | 100° C., 1 hour | 1.0 (1,2-dichloroethane) |
| 18 | Polycarbonate "Z200" | No.1 (2800) | — | — | 100° C., 1 hour | 1.0 |
| 19 | Polycarbonate "Z200" | 1,2-dichloroethane (2800) | PTFE | — | 100° C., 1 hour | 1.1 (1,2-dichloroethane) |
| 20 | B-1 | 1,2-dichloroethane (2800) | PTFE | — | 100° C., 1 hour | 1.1 (1,2-dichloroethane) |
| 21 | Polycarbonate "Z200" | 1,2-dichloroethane (2800) | — | Fine Tin Oxide Particles | 100° C., 1 hour | 1.1 (1,2-dichloroethane) |
| 22 | B-1 | 1,2-dichloroethane (2800) | — | Fine Tin Oxide Particles | 100° C., 1 hour | 1.1 (1,2-dichloroethane) |
| 23 | B-1 | 1,2-dichloroethane (2800) | PTFE | Fine Tin Oxide Particles | 100° C., 1 hour | 1.1 (1,2-dichloroethane) |

Further, Table 1 shows the binder resins in the charge transport layers (surface layers), the kind of solvents (in milliliters), the types of fine organic and inorganic particles, the drying conditions, and residual amounts (by weight percent) of dioxolan series solvents (in Photoreceptors 17, and 19 through 23, 1,2-dichloroethane is employed) of the above-mentioned Photoreceptors 1 through 23.

Electrophotographic properties of Photoreceptors 1 through 14 of the present invention and Comparative Photoreceptors 15 through 23, prepared as mentioned above, were evaluated employing an electrophotographic copier U-BIX 4045 manufactured by Konica Corp.

(Electric Potential Properties during Repetition)

Photoreceptors 1 through 14 of the present invention and Comparative Photoreceptors 15 through 23 were successively mounted into the above copier, which was modified by mounting a surface potentiometer into the development section, and were subjected to 50,000 repetitions of the process of charging, exposure, and discharging. Black paper potential (Vb), white paper potential (Vw), and residual potential (Vr) were measured at the 10th and 50,000th repetitions and the results thereof are shown in Table 2.

(Image Evaluation)

Photoreceptors 1 through 14 and Comparative Photoreceptors 15 through 23 were successively mounted into the above-mentioned copier and were subjected to practical image-forming tests. After producing 50,0000 copies, the generation of image defects such as decrease in image density, background staining, white streaks due to film formed by hygroscopic substances such as toner, paper dust, etc. was observed, and the results are shown in Table 2.

(Wear Resistance)

Each layer thickness of Photoreceptors 1 through 14 and Comparative Photoreceptors 15 through 23 was measured at the initial period of copying and after producing 50,000 copies, and the layer thickness decrease ($\mu$m) of each Photoreceptor was obtained by measuring the difference in the layer thickness at the initial period and after producing 50,000 copies. The results are shown in Table 2.

TABLE 2

| Photo-recep-tor No. | Electric Potential Properties at Repetition: At 10 Repetitions Vb (-V) | Vw (-V) | Vr (-V) | At 50,000 Repetitions Vb (-V) | Vw (-V) | Vr (-V) | Image Evaluation after 50,000 Copies | Layer Decrease (μm) |
|---|---|---|---|---|---|---|---|---|
| 1 | 762 | 112 | 35 | 752 | 128 | 51 | good, however, formation of slight white streaks due to film formation | 1.38 |
| 2 | 759 | 120 | 41 | 749 | 129 | 55 | good, however, formation of slight white streaks due to film formation | 1.30 |
| 3 | 769 | 118 | 39 | 762 | 135 | 62 | good, however, formation of slight white streaks due to film formation | 1.47 |
| 4 | 760 | 114 | 35 | 753 | 131 | 54 | good, however, formation of slight white streaks due to film formation | 1.44 |
| 5 | 759 | 115 | 36 | 752 | 130 | 55 | good, however, formation of slight white streaks due to film formation | 1.43 |
| 6 | 752 | 81 | 29 | 732 | 89 | 33 | good, however, formation of slight white streaks due to film formation | 1.40 |
| 7 | 751 | 83 | 31 | 730 | 91 | 38 | good, however, formation of slight white streaks due to film formation | 1.39 |
| 8 | 764 | 115 | 39 | 760 | 137 | 60 | good, however, formation of slight white streaks due to film formation | 1.35 |
| 9 | 754 | 84 | 30 | 733 | 88 | 34 | good, however, formation of slight white streaks due to film formation | 1.45 |
| 10 | 752 | 82 | 31 | 731 | 90 | 40 | good | 1.36 |
| 11 | 755 | 85 | 34 | 729 | 96 | 44 | good, however, formation of slight white streaks due to film formation | 0.95 |
| 12 | 755 | 84 | 35 | 730 | 95 | 45 | good, however, formation of slight white streaks due to film formation | 0.88 |
| 13 | 757 | 85 | 36 | 731 | 95 | 46 | good, however, formation of slight white streaks due to film formation | 0.79 |
| 14 | 755 | 87 | 38 | 733 | 90 | 40 | good | 0.47 |
| 15 | 765 | 134 | 52 | 766 | 179 | 102 | generation of white streaks due to film formation, background staining, and decrease in image density | 1.60 |
| 16 | 760 | 111 | 36 | 764 | 197 | 138 | large residual potential and much background staining | 1.68 |
| 17 | 760 | 110 | 36 | 752 | 147 | 83 | generation of white streaks due to film formation, background staining and decrease in image density | 1.49 |
| 18 | 764 | 114 | 38 | 752 | 127 | 54 | generation of white streaks due to film formation, background staining and decrease in image density | 1.39 |
| 19 | 755 | 85 | 30 | 725 | 117 | 62 | generation of white streaks due to film formation, background staining and decrease in image density | 1.35 |
| 20 | 757 | 84 | 35 | 723 | 114 | 60 | generation of white streaks due to film formation, background staining and decrease in image density | 1.36 |
| 21 | 752 | 82 | 33 | 719 | 107 | 62 | generation of white streaks due to film formation, background staining and decrease in image density | 1.05 |
| 22 | 753 | 84 | 35 | 717 | 103 | 65 | generation of white streaks due to film formation, background staining and decrease in image density | 0.99 |
| 23 | 756 | 87 | 37 | 719 | 110 | 68 | generation of white streaks due to film formation, background staining and decrease in image density | 0.92 |

Based on Table 2, during repeated image-forming process employing the photoreceptor of the present invention, photoreceptors of the present invention exhibit excellent electrophotographic properties with minimized formation of film caused by hygroscopic substances such as toner, paper dust, etc., degradation of repeated electric potential properties caused by wear, damage, etc., or generation of image defects such as white streaks, decrease in image density, background staining, etc. However, Comparative Photoreceptors exhibit many disadvantages such as the formation of film caused by hygroscopic substances such as toner, paper dust, etc., degradation of repeated electric potential properties caused by wear, damage, etc., or image defects such as white streaks, decrease in image density, background staining, etc. and are found to be unsuitable for commercial use. Furthermore, by incorporating fine organic particles into the surface layer of the photoreceptor of the present invention along with employing the silicon atom-containing binder resin in the same surface layer, cleaning properties are further improved, and the film formation is minimized. When fine organic and inorganic particles are employed together, it is found that a decrease in the layer thickness is synergistically minimized and particularly, stability of the white paper electric potential is improved.

By keeping the specified amount of dioxolan or a derivative thereof in the surface layer of the photoreceptor prepared by coating a photosensitive composition onto a conductive support, improvements in wear resistance and cleaning properties of the surface of the photoreceptor obtained by incorporating a silicon or fluorine atom-containing binder resin or fine organic or inorganic particles into the surface layer of the photoreceptor are enhanced, and excellent advantages are exhibited such that no fatigue degradation results during repeated image-forming process employing the photoreceptor; no background staining is caused over an extended period; clear and sharp images with high density are consistently obtained, and the like.

What is claimed is:

1. An electrophotographic photoreceptor comprising:

a conductive support, a photosensitive layer and a surface layer provided thereon;

said surface layer comprising a binder resin containing silicon or fluorine atoms and fine inorganic particles of oxides of silicon or tin, wherein said surface layer is formed by coating and drying a solution of said binder resin in dioxolan or derivative thereof as a solvent and said dioxolan or said derivative thereof remaining in the surface layer is 0.001 to 10 weight percent.

2. An electrophotographic photoreceptor comprising:

a conductive support;

a photosensitive layer and a surface layer provided thereon;

said surface layer comprising a binder resin containing a silicon or fluorine atom, wherein said surface layer is formed by coating and drying a solution of said binder resin in dioxolan or a derivative thereof as a solvent and said dioxolan or said derivative thereof remaining in the surface layer is 0.01 to 3.5 weight percent.

3. The electrophotographic photoreceptor of claim 2 wherein the binder resin is a polycarbonate or a copolymer thereof.

4. The electrophotographic photoreceptor of claim 2 wherein the surface layer comprises fine organic particles.

5. The electrophotographic photoreceptor of claim 4 wherein the fine organic particles are a compound containing fluorine.

6. The electrophotographic photoreceptor of claim 2 wherein the surface layer comprises fine inorganic and organic particles.

7. The electrophotographic photoreceptor of claim 2 wherein the surface layer contains silicone oil.

8. The electrophotographic photoreceptor of claim 2 wherein said photosensitive layer further comprises a charge generating layer and a charge transferring layer, said charge transferring layer being located on said charge generating layer.

9. The electrophotographic photoreceptor of claim 8 wherein said surface layer is said charge transferring layer.

10. The electrophotographic photoreceptor of claim 2 wherein the dioxolan or dioxolan derivative is represented by a formula

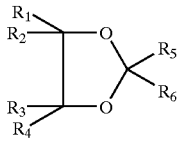

wherein $R_1$ to $R_6$ each represents a hydrogen atom or a substituted or unsubstituted alkyl group having from 1 to 6 carbon, $R_5$ and $R_6$, or at least two groups of $R_1$ to $R_4$ may combine with each other to complete a ring.

11. The electrophotographic photoreceptor of claim 10 wherein $R_1$ to $R_6$ each represents a hydrogen atom or a substituted or unsubstituted alkyl group having from 1 to 4 carbon atoms.

12. The electrophotographic photoreceptor of claim 10 wherein $R_1$ to $R_6$ each represents a hydrogen atom.

13. The electrophotographic photoreceptor of claim 10 wherein $R_1$ to $R_6$ each represents an unsubstituted alkyl group having from 1 to 4 carbon atoms.

14. The electrophotographic photoreceptor of claim 10 wherein $R_1$ to $R_6$ each represent an alkyl group having from 1 to 4 carbon atoms wherein the alkyl group is substituted by an alkoxy group having from 1 to 4 carbon atoms, an acyl group, an acyloxy group, or a hydroxyl group.

15. The electrophotographic photoreceptor of claim 2 wherein the dioxolan is selected from the group consisting of the following compounds:

No.1

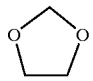

No.2

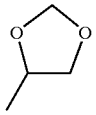

No.3

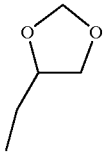

No.4

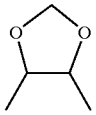

No.5

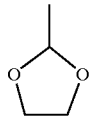

No.6

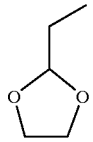

No.7

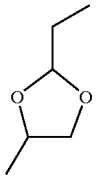

No.8

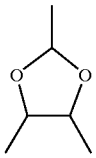

-continued
No.9
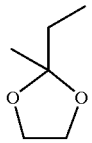
No.10
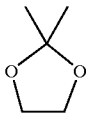
No.11
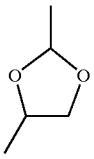
No.12
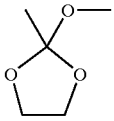
No.13
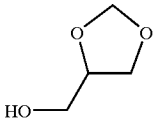
No.14
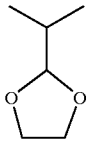
No.15
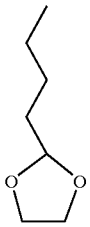
No.16
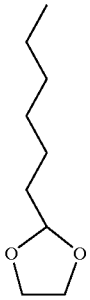
-continued
No.17
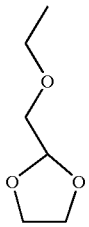
No.18
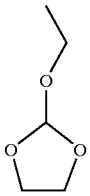
No.19
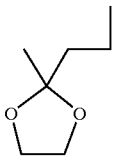
No.20
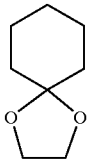
No.21
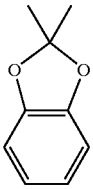
No.22
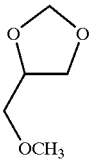
No.23
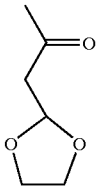
and
No.24
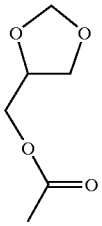
* * * * *